US009708781B2

(12) United States Patent
Sanders et al.

(10) Patent No.: US 9,708,781 B2
(45) Date of Patent: Jul. 18, 2017

(54) BARRIER WALL AND METHOD OF FORMING WALL PANELS BETWEEN VERTICAL WALL STIFFENERS WITH SUPPORT MEMBERS EXTENDING PARTIALLY THROUGH THE WALL PANELS

(71) Applicant: Mute Wall Systems, Inc., Peoria, AZ (US)

(72) Inventors: Keith A. Sanders, Litchfield Park, AZ (US); Donald J. Parks, Prescott, AZ (US); James L. Beavers, Jr., Prescott, AZ (US)

(73) Assignee: Mute Wall Systems, Inc., Peoria, AZ (US)

( * ) Notice: Subject to any disclaimer, the term of this patent is extended or adjusted under 35 U.S.C. 154(b) by 18 days.

(21) Appl. No.: 14/021,034

(22) Filed: Sep. 9, 2013

(65) Prior Publication Data

US 2014/0007527 A1 Jan. 9, 2014

Related U.S. Application Data

(63) Continuation of application No. 12/791,754, filed on Jun. 1, 2010, now Pat. No. 8,561,371, which is a (Continued)

(51) Int. Cl.
*E04B 2/08* (2006.01)
*E01F 8/00* (2006.01)
(Continued)

(52) U.S. Cl.
CPC ..... *E01F 8/0023* (2013.01); *E04B 1/14* (2013.01); *E04B 1/80* (2013.01); *E04B 2/08* (2013.01);
(Continued)

(58) Field of Classification Search
CPC ... E04H 17/1404; E04H 17/16; E04H 17/168; E04B 2/58; E04B 2/08; E04B 2/64;
(Continued)

(56) References Cited

U.S. PATENT DOCUMENTS 1,661,128 A 2/1928 Mankedick
1,668,551 A * 5/1928 Crosman ..... A63H 33/084 446/122

(Continued)

*Primary Examiner* — Christine T Cajilig
(74) *Attorney, Agent, or Firm* — Robert D. Atkins; Patent Law Group: Atkins and Associates, P.C.

(57) ABSTRACT

A sound barrier wall has a plurality of footings spaced apart and vertical "I" beam wall stiffeners mounted to the footings. Alternatively, the vertical wall stiffeners are mounted to a crash barrier. A horizontal wall stiffener can be disposed between the adjacent vertical wall stiffeners. A plurality of wall panels is vertically stacked between adjacent vertical wall stiffeners. Each wall panel includes a sound insulating block, and plurality of support members disposed on opposite sides of the sound insulating block for providing structural support. Each support member has a head portion in contact with a surface of the sound insulating block and a stem portion extending into the sound insulating block. An "I" beam can be disposed between the vertically stacked wall panels. A top cap is mounted over the vertically stacked wall panels and protective layer is formed over the wall panels and vertical wall stiffeners.

22 Claims, 32 Drawing Sheets

Related U.S. Application Data continuation-in-part of application No. 11/626,991, filed on Jan. 25, 2007, now abandoned.

(60) Provisional application No. 60/782,372, filed on Mar. 14, 2006.

(51) Int. Cl.

| | |
|---|---|
| ***E04B 1/14*** | (2006.01) |
| ***E04B 1/80*** | (2006.01) |
| ***E04B 2/58*** | (2006.01) |
| ***E04C 2/20*** | (2006.01) |
| *E04B 1/24* | (2006.01) |

(52) U.S. Cl.

CPC ..... *E04B 2/58* (2013.01); *E04C 2/205* (2013.01); *E04B 2001/2481* (2013.01)

(58) Field of Classification Search

CPC ..... E04B 2/80; E01F 8/0017; E01F 15/08; E01F 15/086

USPC ... 52/145, 309.7, 309.16, 586.1, 586.2, 762, 52/764, 780, 745.09; 256/13.1, 19

See application file for complete search history.

(56) References Cited

U.S. PATENT DOCUMENTS

| | | | | | |
|---|---|---|---|---|---|
| 2,107,691 | A | * | 2/1938 | Corser | A63H 33/105 209/358 |
| 2,130,231 | A | * | 9/1938 | Forciea | E04B 2/702 403/346 |
| 2,664,740 | A | * | 1/1954 | Cochrane | 52/781 |
| 2,676,482 | A | * | 4/1954 | Wilson | E04B 2/48 52/564 |
| 3,193,255 | A | * | 7/1965 | Burdett | 256/19 |
| 3,295,278 | A | | 1/1967 | Muhm | |
| 3,353,315 | A | | 11/1967 | Barker | |
| 3,381,483 | A | * | 5/1968 | Huthsing, Jr. | 405/262 |
| 3,600,867 | A | * | 8/1971 | Shuey | 52/284 |
| 3,603,053 | A | * | 9/1971 | Van Loghem et al. | 52/285.1 |
| 3,617,028 | A | * | 11/1971 | Bach et al. | 256/19 |
| 4,031,285 | A | | 6/1977 | Miller et al. | |
| 4,063,714 | A | * | 12/1977 | Kirkwood | 256/24 |
| 4,143,495 | A | | 3/1979 | Hintz | |
| 4,284,447 | A | | 8/1981 | Dickens et al. | |
| 4,364,546 | A | * | 12/1982 | Lyman et al. | 256/24 |
| 4,566,558 | A | | 1/1986 | Link, Jr. et al. | |
| 4,621,477 | A | * | 11/1986 | Kinst | 52/780 |
| 4,641,468 | A | | 2/1987 | Slater | |
| 4,685,656 | A | * | 8/1987 | Lee | E01F 15/025 256/13.1 |
| 4,754,587 | A | | 7/1988 | Glaser | |
| 5,015,119 | A | | 5/1991 | Schmanski | |
| 5,100,107 | A | * | 3/1992 | Latta | 256/19 |
| 5,426,267 | A | * | 6/1995 | Underhill et al. | 181/210 |
| 5,524,400 | A | | 6/1996 | Schmechel | |
| 5,572,847 | A | * | 11/1996 | Elmore et al. | 52/766 |
| 5,702,090 | A | * | 12/1997 | Edgman | 256/19 |
| 5,799,462 | A | | 9/1998 | McKinney | |
| 5,893,248 | A | | 4/1999 | Beliveau | |
| 5,966,885 | A | * | 10/1999 | Chatelain | 52/309.4 |
| 5,984,044 | A | * | 11/1999 | Christensen | 181/210 |
| 6,138,426 | A | * | 10/2000 | Mork et al. | 52/562 |
| 6,164,035 | A | * | 12/2000 | Roberts | 52/563 |
| 6,240,693 | B1 | * | 6/2001 | Komasara et al. | 52/439 |
| 6,371,699 | B1 | | 4/2002 | Weinreb | |
| 6,408,594 | B1 | | 6/2002 | Porter | |
| 6,609,347 | B2 | * | 8/2003 | Morrow | 52/745.1 |
| 6,698,157 | B1 | * | 3/2004 | Porter | 52/794.1 |
| 6,701,684 | B2 | * | 3/2004 | Stadter | 52/309.7 |
| 6,782,673 | B2 | * | 8/2004 | Azar | 52/604 |
| 6,883,786 | B2 | * | 4/2005 | Bebendorf | 256/19 |
| 7,665,264 | B1 | * | 2/2010 | Wolfe | 52/586.2 |
| 7,762,033 | B2 | * | 7/2010 | Scott | E04B 2/06 52/274 |
| 8,468,767 | B1 | * | 6/2013 | McBride | 52/586.2 |
| 2002/0134043 | A1 | | 9/2002 | Winterfeld | |
| 2002/0170259 | A1 | * | 11/2002 | Ferris | 52/596 |
| 2005/0257494 | A1 | | 11/2005 | Brandes | |
| 2006/0026922 | A1 | * | 2/2006 | Li | 52/586.2 |
| 2006/0183269 | A1 | | 8/2006 | Fuergut et al. | |
| 2006/0191232 | A1 | | 8/2006 | Salazar et al. | |
| 2007/0227086 | A1 | | 10/2007 | Beavers et al. | |
| 2010/0180527 | A1 | * | 7/2010 | Kim | 52/309.13 |

* cited by examiner

BARRIER WALL AND METHOD OF FORMING WALL PANELS BETWEEN VERTICAL WALL STIFFENERS WITH SUPPORT MEMBERS EXTENDING PARTIALLY THROUGH THE WALL PANELS

CLAIM TO DOMESTIC PRIORITY

The present application is a continuation of U.S. patent application Ser. No. 12/791,754, now U.S. Pat. No. 8,561,371, filed Jun. 1, 2010, which is a continuation-in-part of U.S. patent application Ser. No. 11/626,991, now abandoned, filed Jan. 25, 2007, which claims the benefit of Provisional Application No. 60/782,372, filed Mar. 14, 2006, which applications are incorporated herein by reference.

FIELD OF THE INVENTION

The present invention relates in general to construction materials and, more particularly, to a barrier wall and method of forming wall panels between vertical wall stiffeners with support members extending partially through the wall panels.

BACKGROUND OF THE INVENTION

Residential and commercial building construction uses a variety of building materials and construction techniques to complete the structure. In some building projects, lumber or metal studs are used for the framing. The frame structure is held together with nails, screws, and bolts. An exterior siding such as stucco, wood, vinyl, brick, or aluminum is placed over the frame structure. Insulation is placed between the studs of the frame structure. The interior coverings such as drywall are affixed to the inside of the frame structure. The entire building project is typically performed on the construction site. The use of interior and exterior siding over frame is costly and labor and time intensive. Wood framing is of inferior quality and subject to insect damage and warping. Metal framing is thermally conductive which is undesirable in view of energy costs. The frame-based structure is susceptible to the effects of aging and storm damage. While frame construction has been dominant in the building industry for many years, other more cost effective and time efficient solutions are becoming more common.

One alternative building approach involves the use of hollow sectional forms, which are put together in the shape of the exterior wall. The hollow forms are filled with concrete and then disassembled when the concrete cures, leaving a concrete wall. The concrete wall is long-lasting and strong against the elements, but the forms are generally expensive to setup.

Another building approach involves the use of pre-fabricated building panels which are manufactured off-site and then assembled together on-site. One such building panel is discussed in U.S. Pat. No. 6,796,093 as having a plurality of I-beam-shaped metal struts spaced about 18 inches apart with insulating foam blocks disposed between the metal struts. The metal struts have cut-outs along the length of the I-beam to reduce the total metal area and associated thermal conductivity. FIG. 1 shows exemplary prior art I-beam metal strut 12 between foam blocks 14. While the structural panel has good load-bearing characteristics, the I-beam metal strut 12 is continuous across foam block 14, at least through portions of the metal struts and, consequently, is thermally conductive through the continuous metal areas. Since I-beams 12 go completely through foam blocks 14, heat and cold will conduct from one side to the other side of the wall structure. In the summer, I-beam 12 conducts heat from the exterior to the interior of the building. In the winter, I-beam 12 conducts cold from the exterior to the interior of the building. In any case, the I-beam construction decreases the thermal insulation property of the building panels.

In another application, a retaining wall can be built to hold back earth, water, or otherwise create a barrier. The barrier wall can be used for security purposes, e.g. to control ingress and egress of people and objects to a restricted area, such as a military base, secure facility, or hazardous area. In the case of a prison, the barrier wall serves to keep people and objects contained within a designated area. The barrier wall can be used for privacy purposes to create a visual barrier around a private home community or business development, as well as control ingress and egress to designated entrances and exits. In another application, a barrier wall can be built one or both sides of a roadway adjacent to a residential or commercial area. The barrier wall serves to block traffic noise, as well as form a visual and safety barrier. The barrier prevents pedestrians and animals from crossing the roadway. By blocking traffic noise, the barrier wall serves to maintain property value and enable quiet enjoyment of the area adjacent to the roadway.

To construct a barrier wall, a footing is formed along an entire length of the barrier wall for structural support. The footing can be concrete, natural materials, or man-made materials. The footing is typically wider than the wall and formed below ground level. In the case of a concrete footing, the ground is excavated to a solid foundation and a rebar structure is formed in the footing area by wiring together individual rebar rods. A portion of the rebar extends above the footing to tie into the wall structure. The footing area is filled with concrete to enclose the rebar structure.

A concrete form is placed over the footing. The concrete form typically contains wood or fiberglass panels separated by a width of the wall, e.g. 8-12 inches. Construction design rules typically limit the height of the concrete form to 8 feet and length to 15 feet. A rebar structure is formed between the wood panels by wiring together individual rebar rods. The rebar structure is also tied to the rebar extending from the footing. The wood panels are tied together at a plurality of locations across the empty space between the wood panels for strength during the subsequent concrete pour. Again, concrete is poured between the wood panels to enclose the rebar structure. When the concrete is cured, the wood panels are removed leaving a first rebar-reinforced concrete barrier wall section with a length of 15 feet and height of 8 feet.

If the barrier wall specification is higher than the concrete form limitation, then a second concrete form with wood panels is placed over the first concrete wall section. Again, a rebar structure is formed between the wood panels by wiring together individual rebar rods. The rebar structure is also tied to the rebar extending from the first concrete wall. Concrete is poured between the wood panels of the second concrete form to enclose the rebar structure. When the concrete is cured, the wood panels are removed leaving a second rebar-reinforced concrete barrier wall disposed over the first concrete wall section. The barrier wall now has the same length of 15 feet but with an extended height of 16 feet. Of course, another concrete wall section must be formed on the footing to extend the length of the wall, and additional concrete wall sections must be formed vertically to extend the height of the wall. The process continues section-by-section, both horizontally and vertically, until the wall reaches the total height and length required in the barrier wall specification.

The aforedescribed process of forming concrete barrier walls is time consuming and expensive. The barrier wall must be built horizontally and vertically section-by-section and may extend for many miles in the case of barrier walls along roadways. Significant labor and material costs are required to form the footing, set the concrete forms with rebar, pour the concrete, and allow adequate curing time for each section. A number of vocational tradesmen are needed, including masonry, heavy equipment operators, carpenters, painters, safety personal, insurance, permits, etc. Most if not all work must be performed at the job site, which may experience weather delays, material delays, work coordination issues, terrain issues, as well as subjecting traffic and residents to construction issues.

SUMMARY OF THE INVENTION

A need exists for a barrier wall combining sound reduction, strength, and low manufacturing cost. In one embodiment, the present invention is a barrier wall comprising a plurality of vertical wall stiffeners and a plurality of insulating blocks vertically stacked between the vertical wall stiffeners. A first groove is formed in a top surface of the insulating blocks. A second groove is formed in a bottom surface of the insulating blocks. A horizontal support member is disposed within the first and second grooves between the vertically stacked insulating blocks.

In another embodiment, the present invention is a barrier wall comprising a plurality of vertical wall support members. A first wall panel is disposed between the vertical wall support members and includes a first groove in a top surface of the first wall panel. A second wall panel is disposed over the first wall panel and includes a second groove in a bottom surface of the second wall panel.

In another embodiment, the present invention is a method of making a barrier wall comprising the steps of providing a first wall panel including a first groove in a top surface of the first wall panel and stacking a second wall panel over the first wall panel. The second wall panel includes a second groove in a bottom surface of the second wall panel. The method further includes the step of disposing a horizontal support member between the first and second wall panels and within the first and second grooves.

In another embodiment, the present invention is a method of making a barrier wall comprising the steps of providing a first wall panel including a first groove formed in a first surface and a second groove formed in a second surface opposite the first surface and disposing a second wall panel over the first wall panel.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Residential, commercial, and industrial building construction can be done much more efficiently and cost effectively with pre-manufactured wall, roof, floor, and ceiling panels. The pre-manufactured panels can be made in a controlled environment, such as a manufacturing facility, shipped to the construction site, and then assembled together to form the walls and roof of the building. The pre-manufactured panels stand strong against adverse environmental conditions, such as wind, rain, snow, hurricane, flood, and earthquake. The wall and roof panels are easy to assemble into the complete building structure on the job site. As will be demonstrated, the wall and roof panels of the present invention provide improved insulation, i.e., higher R-value insulation factor, as compared to the prior art.

To construct a building with the wall and roof panels as described herein, an architect or builder will design and layout the building structure. The building may be a home, office, industrial, hotel, or commercial structure of any size and shape and as tall as the local building codes permit. The building designer will specify a blueprint of the building, including dimensions for the walls and roof. The designer then selects wall and roof panels to conform to the building blueprint, i.e., the walls and roof are made with a plurality of building panels assembled together according to the design. The panels can be round, rectangle, triangle, curved, polygon, or any other convenient shape. The selected panels are connected together on the job site to form the walls and roof of the building. The building panels can be stacked on-end with appropriate support for multi-story structures.

Figure 2:
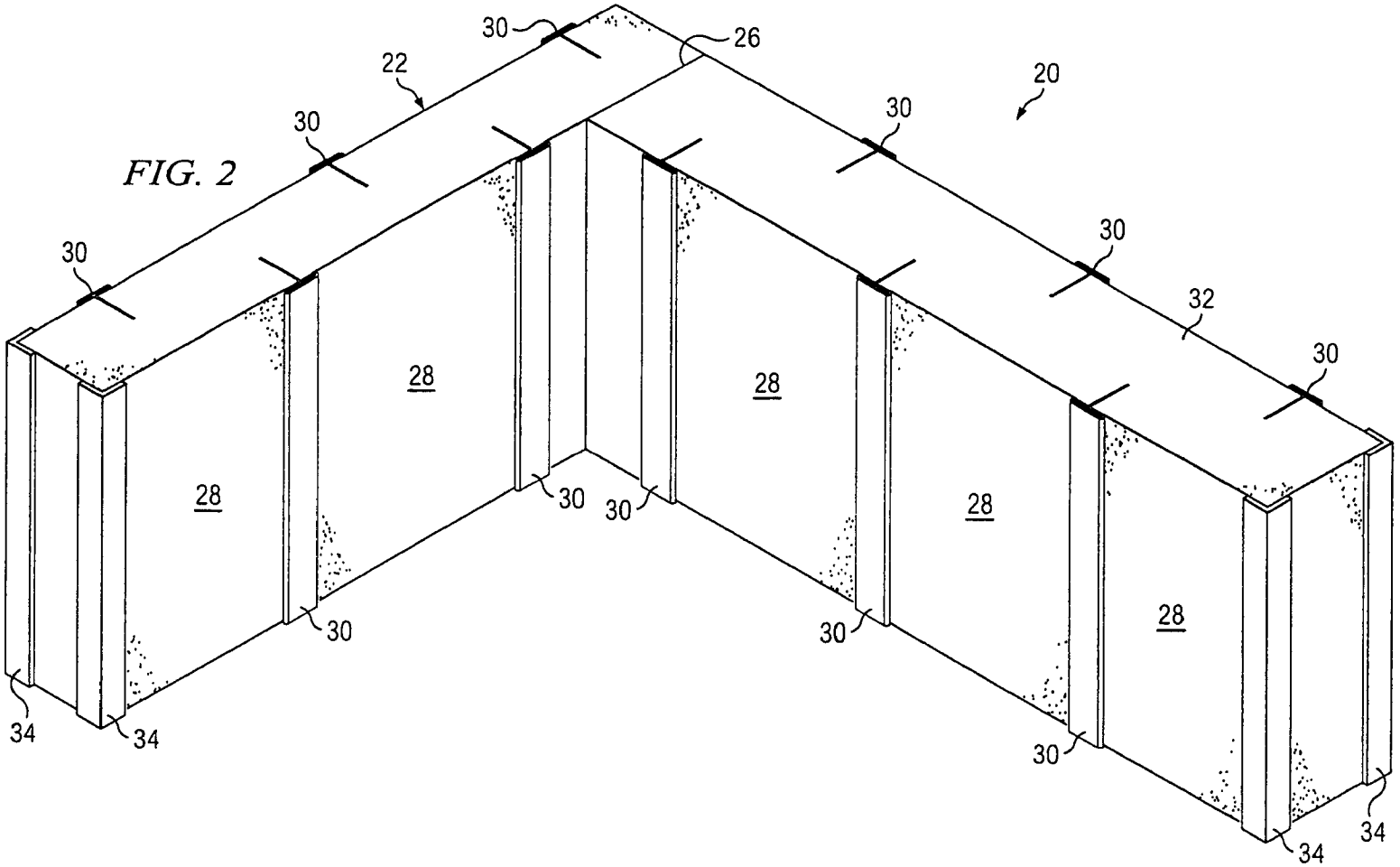
FIG. 2 illustrates interconnected foam-filled wall panels with support members inserted partially into the panel.

FIG. 2 illustrates a portion of building structure 20 with two building panels or sections 22 connected together at joint 26. Building panels are each made with one or more insulating blocks 28. The insulating blocks 28 may be made with expanded polystyrene (EPS) foam formed in 48-inch blocks. Alternatively, the blocks 28 can have other lengths and be made with fiberglass, paper, or any other thermally insulating material. The height of each insulating block depends on the building design, typically ranging from 8-10 feet. The thickness of the insulating blocks ranges from 4-8 inches. In other embodiments, the insulating blocks may range from 2 to 12 inches in thickness. For walls greater than 48 inches in length, a plurality of insulating blocks 28 are interconnected to run the length of the wall. Adjacent insulating blocks 28 are held together with an adhesive, e.g., urethane glue. Building panel 22 may have side end caps 34 for support and protection of the foam block. Building panel 22 may also have top and bottom end caps (not shown). The top cap is a metal angle or "L"-shaped brace running along the top perimeter of panel 22, contacting the top and sides of the insulating blocks. The bottom cap is a metal angle or "L"-shaped brace running along the bottom perimeter of panel 22, contacting the bottom and sides of the insulating blocks. For the wall panels, the bottom cap may be formed in or attached to the foundation of the building structure to aid in aligning the walls and to meet hurricane and earthquake standards.

Support members or struts 30 are inserted into insulating blocks 28 to provide structural support and withstand the environmental elements, e.g., wind, rain, and snow. The building panels 22 are also resistant to water, mold, mildew, insects, fire, hurricanes, and earthquakes. Support members 30 and insulating blocks 28 complement one another to provide a strong yet thermally isolating building panel. Support member 30 can be made from a variety of materials capable of providing structural support with the insulating block, such materials including metal (steel, aluminum or composite metal), ceramic, concrete, fiberglass, graphite, wood, plastic, cardboard, rubber, and composites of such materials.

In one embodiment, support members 30 are formed in the shape of a "T" and run the height of the wall, from top to bottom. The stem of support member 30 extends partially into the insulating block 28 but does not extend completely through the insulating block. The support members 30 are installed on opposite sides of panel 22, in an alternating pattern and offset or staggered with respect to the adjacent support members on the other side of the building panels, as shown in FIG. 2. The support members are about 12-18 inches apart on center of each member, and about 24-36 inches apart on each side of the building panel.

The use of panel 22 provides several advantages for building construction. The building panels can be made off-site, in a controlled environment such as a manufacturing facility, and then transported to and assembled at the building site. The off-site manufacturing provides cost saving efficiencies in terms of accessibility to mass production equipment, sheltered work environment, and ready access to raw materials. The building panels can be formed to any size and shape in accordance with the building design. The panels can be straight, curved, angled, etc. The insulating blocks 28 provide exceptional insulation properties against the outside elements. Each inch of thickness of the insulating block yields about R-4 insulation factor. A 6-inch thick foam panel would provide about R-24 value of insulation. The support members 30 provide structural strength to panel 22. With support members 30, an 8-foot by 8-foot by 6-inch section of panel 22 can withstand in excess of 27,000 lbs. of total axial loading directed against surface 32.

Figure 1:
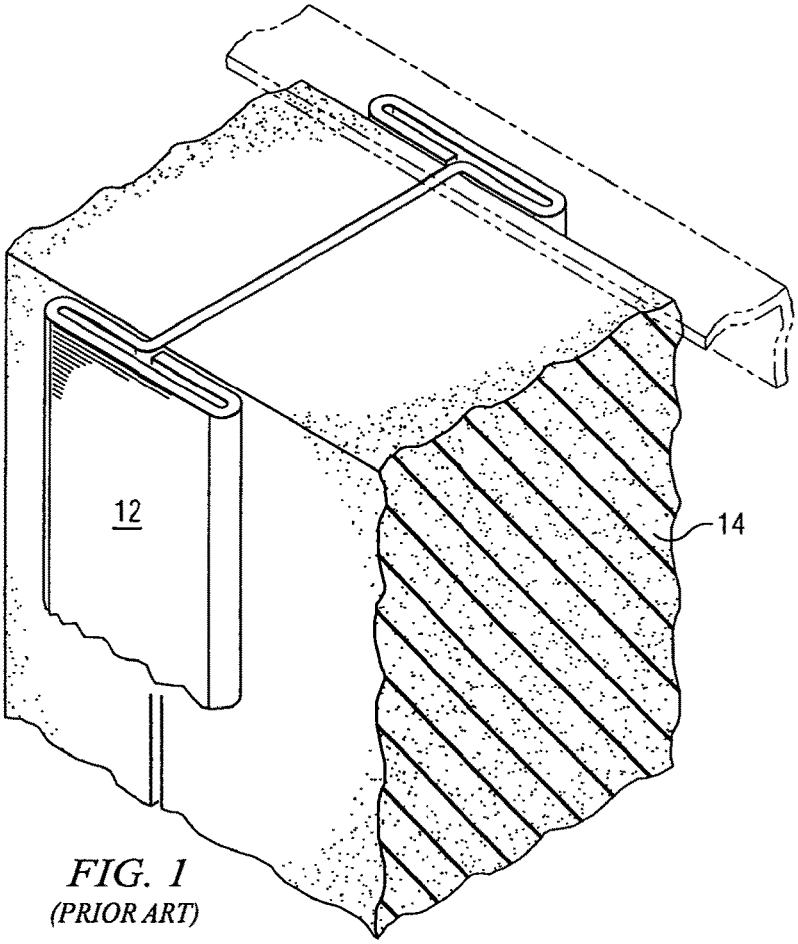
FIG. 1 (PRIOR ART)
FIG. 1 illustrates a known wall panel with I-beam strut disposed completely through the panel.

In most if not all prior designs, the support struts in the foam blocks are continuous through the panel, see exemplary I-beam 12 in FIG. 1. The continuous metal structure of I-beam 12 through foam block 14 provides a continuous thermal conduction path from the interior surface to the exterior surface that reduces the R-value insulation factor of the prior art panel.

An important feature of building panel 22 is its thermal non-conductivity properties in combination with the structural strength it provides. The thermal non-conductivity property of panel 22 arises from the fact the support members extend only partially through the building panel. As seen in FIG. 2, each support member 30, on both sides of panel 22, stops in the interior portion of the insulating block 28 and does not extend completely through from the interior surface to the exterior surface of the building panel. In one embodiment, the support member extends about half way through the insulating block. In a 6-inch insulating block, the "T" support member extends about 3 inches into the insulating block. Support members 30 are typically made with metal and as such have high thermal conductive properties. The support members 30 inherently exhibit a thermal conduction path through the metal. The foam portion of panel 22 has high thermal insulation properties. Since the support members 30 do not extend all the way from the interior surface to the exterior surface of panel 22, there is no channel of high thermal conductivity from the interior surface to the exterior surface in the body of the building panel. Thus, the thermal conduction path associated with the support members is discontinuous through panel 22 as the insulating material blocks the thermal transfer at the point where the support member stops in the interior of the insulating block 28.

It is understood that thermal transfer through panel 22 is not completely eliminated with the use of support members 30 as insulating blocks 28 are not perfect thermal isolators. However, the high thermal transfer associated with the metal support members is certainly discontinuous across the wall panel 22 and as such significantly improves its R-value insulation factor for the wall panel as a whole.

The structural strength of building panel 22 arises from the arrangement of the support members 30 in the insulating blocks 28. Each "T"-shaped support member 30 has a head portion parallel to and in contact with the interior and exterior surfaces of panel 22. The stem of the "T"-shaped support member extends into the insulating block 28. The "T"-shaped support members 30 are positioned on opposite sides of panel 22, in an alternating pattern and offset or staggered with respect to the adjacent support members on the opposite side of the building panel. The embedded stem of support members 30, arranged as shown in FIG. 2, increases the structural strength of panel 22, while reducing the amount of steel needed within the insulating blocks and associated weight, as compared to the I-beam support member 12 in FIG. 1.

Figure 3:
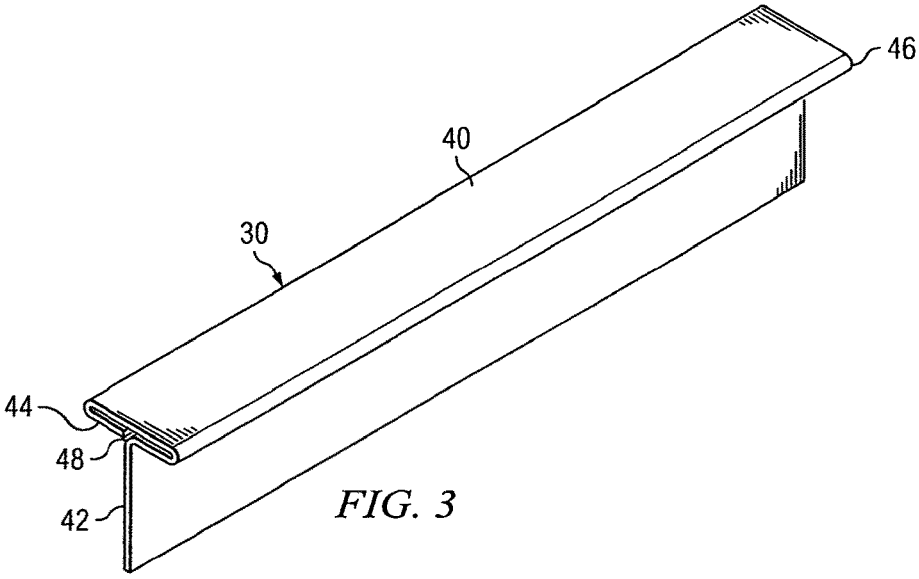
FIG. 3 illustrates a "T"-shaped support member.

The support member 30 is shown in FIG. 3 having head portion 40 and stem portion 42. The support member is formed from a rolled sheet of steel that is bent to the desired "T" shape. The steel is 20 gauge thickness, although other gauge steel could be used as well. The "T"-shape of the support member is formed using a sheet metal bending machine and process. At about 1 inch into the width of the steel plate a first 180° bend is made at point 44, commonly known as a "double-hem." At another 2 inches into the width of the steel plate a second 180° bend is made at point 46. At another 1 inch into the width of the steel plate a third bend at 90° is made at point 48. The steel plate is cut at about 3 inches past point 48 to form stem 42. The result is the double-hem "T"-shaped support member 30 having head portion 40 width of 2 inches, stem portion 42 of 3 inches, and a length the same as the height of panel 22, i.e., 8-10 feet. In other embodiments, the head portion 40 can range from 2-4 inches and the stem portion 42 can range from 1-6 inches.

Figure 4:
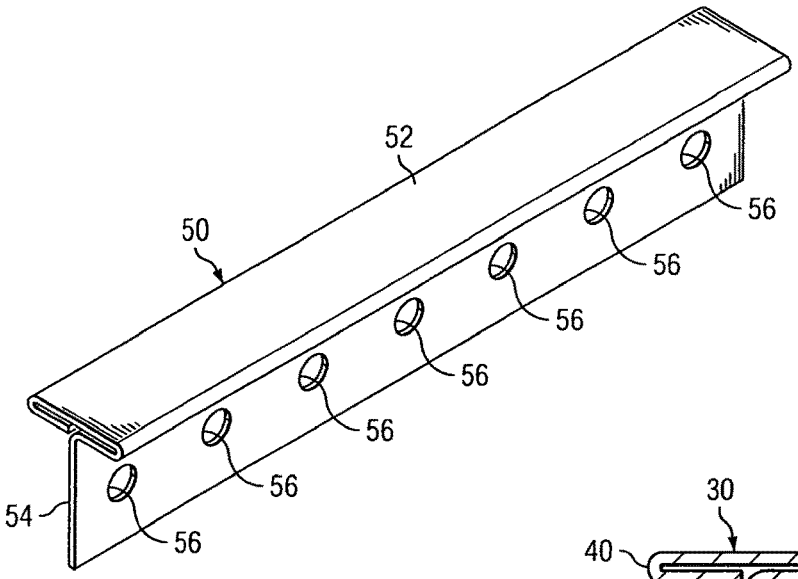
FIG. 4 illustrates the "T"-shaped support member with multiple cut-outs.
Figure 5:
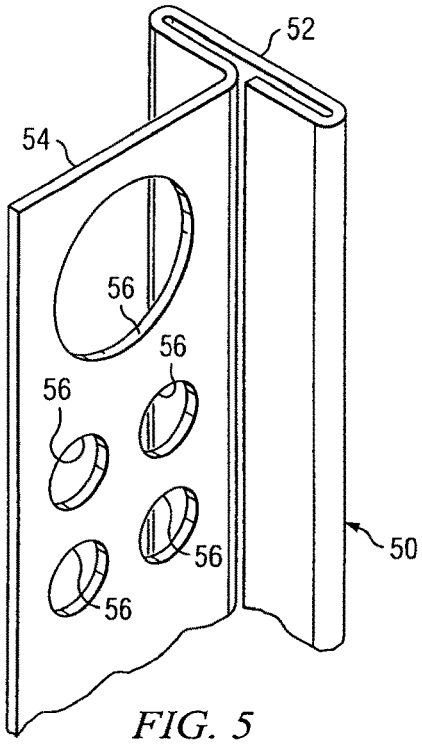
FIG. 5 illustrates the "T"-shaped support member with alternative cut-outs.

A support member 50 is shown in FIG. 4 having the same dimensions as support member 30 including head portion 52 and stem portion 54. The support member 50 has a plurality of cut-outs or openings 56 formed in the stem portion 52. FIG. 5 shows that support member 50 can have cut-outs or openings 56 of different sizes, shapes, and patterns. The cut-outs reduce the thermal conductivity and weight of the support member without significantly reducing its structural strength for panel 22.

Figure 6:
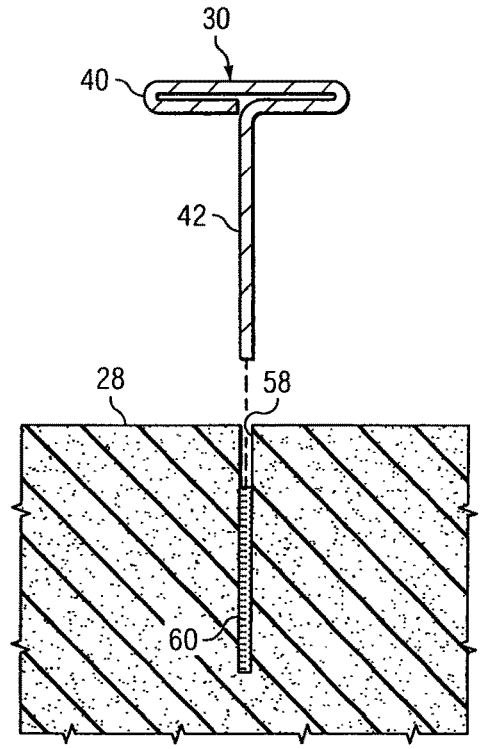
FIG. 6 illustrates the "T"-shaped support member for insertion into the foam-filled panel.

FIG. 6 illustrates in cross-section groove or slot 58 cut into a side surface of insulating blocks 28 from the bottom to the top of panel 22. For a 6-inch thick insulating block, the groove 58 is about 3 inches deep into the insulating block. An adhesive 60 such as urethane glue is disposed into groove 58. A groove 58 is cut into insulating blocks 28 of panel 22 for each support member 30. The stem portion 42 of support members 30 are then inserted into the groove 58 until the head portion 40 contacts the surface of insulating block 28. The stem portion 42 cures with adhesive 60 and forms a secure union between support member 30 and insulating block 28.

Figure 7:
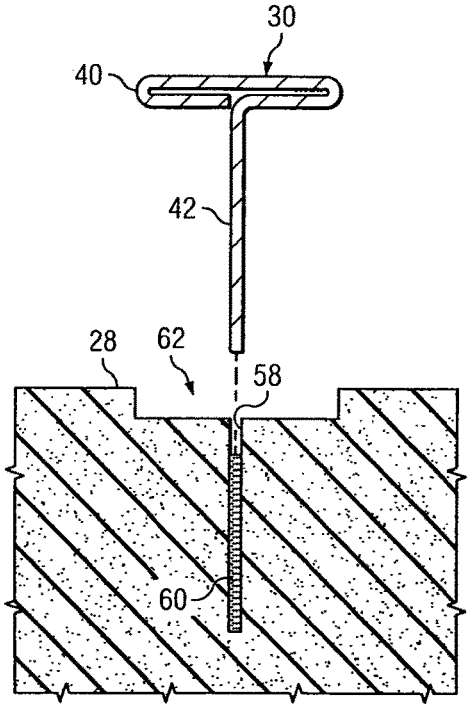
FIG. 7 illustrates the "T"-shaped support member for insertion into a recess of foam-filled panel.

In an alternative embodiment, a shallow trench or recess 62 is cut into insulating block 28 to sufficient depth to contain head portion 40, as shown in cross-section in FIG. 7. The stem portion 42 is inserted into groove 58 to cure with adhesive 60. The top surface of head portion 40 is co-planar with the side surface of insulating blocks 28 and provides a flush surface for panel 22.

Figure 8:
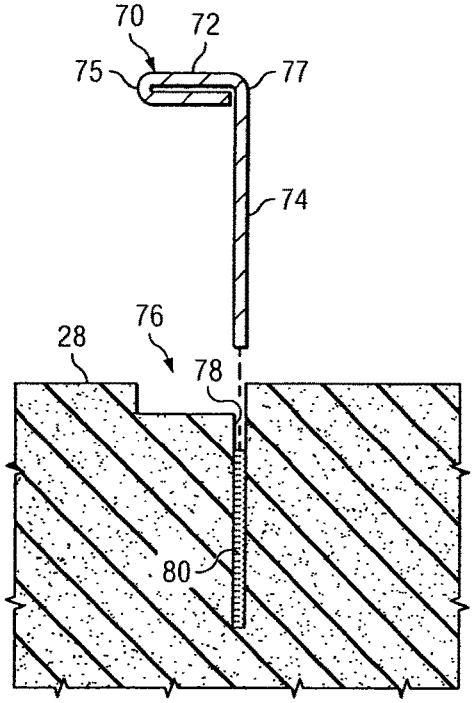
FIG. 8 illustrates an "L"-shaped support member for insertion into a recess of the foam-filled panel.

Another embodiment for the support member is shown in cross-section in FIG. 8. The "L"-shaped support member 70 has head portion 72 and stem portion 74. The support member is formed from a rolled sheet of steel that is bent to the "L" shape. About 1 inch into the width of the steel plate a first 180° bend is made at point 75. At another 1 inch into the width of the steel plate a third bend at 90° is made at point 77. The steel plate is cut at about 3 inches past point 77 to form stem 74. The result is an "L"-shaped support member 70 having head portion 72 width of 1 inch, stem portion 74 of 3 inches, and a length the same as the height of panel 22, i.e., 8-10 feet.

A shallow trench or recess 76 is cut into insulating block 28 to sufficient depth to contain head portion 72. A groove 78 cut into a side surface of insulating blocks 28 from the bottom to the top of panel 22. For a 6-inch thick insulating block, the groove 78 is cut about 3 inches deep into the insulating block. An adhesive 80 such as urethane glue is disposed into groove 78. A groove 78 is cut into insulating blocks 28 of panel 22 for each support member 30. The stem portion 74 of support members 70 are then inserted into the grooves 78 until the top surface of head portion 74 is co-planar with the side surface of insulating blocks 28. The recessed head portion provides a flush surface for panel 22.

Figure 9:
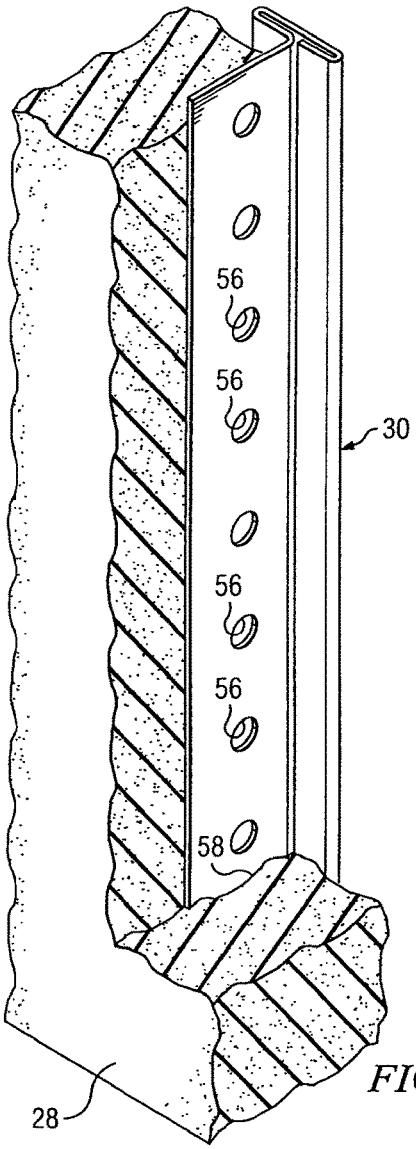
FIG. 9 illustrates a cut-away of the foam-filled panel with the "T"-shaped support member installed.

FIG. 9 shows a cut-away of insulating block 28 with support member 30 in place. Note that the cut-outs or openings 56 in the support member 30 also improve the adhesive of the stem portion to the insulating block 28. Alternatively, the stems portions can be textured, roughened, corrugated, or partially punched for better adhesion in groove 58 to the insulating block.

FIGS. 10*a*-10*f* illustrate alternative embodiments of the support members. Each figure is a cross-sectional view of panel 22.

Figure 10A:
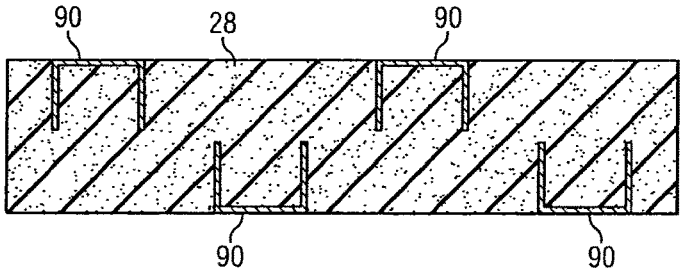
FIGS. 10*a*-10*f* illustrate a top view of the foam-filled panel with different arrangements of support members.

FIG. 10*a* shows "U"-shaped support members 90 disposed in insulating block 28 extending the height of panel 22. The "U"-shaped support members 90 are formed by making two 90° bends in the sheet of steel. The "U"-shaped support member 90 has a head portion and two stem portions extending partially into insulating block 28, but does not extend all the way through from the interior surface to the exterior surface of panel 22. Accordingly, the thermal conduction path through panel 22, attributed to the metal support members, is discontinuous. The support members 90 are installed on opposite sides of panel 22, in an alternating pattern and offset or staggered with respect to the adjacent support members on the other side of the building panel. The support members are about 12-18 inches apart on center of each member. The "U"-shaped support member 90 can also be recessed into insulating block 28 as described in FIG. 7.

Figure 10B:
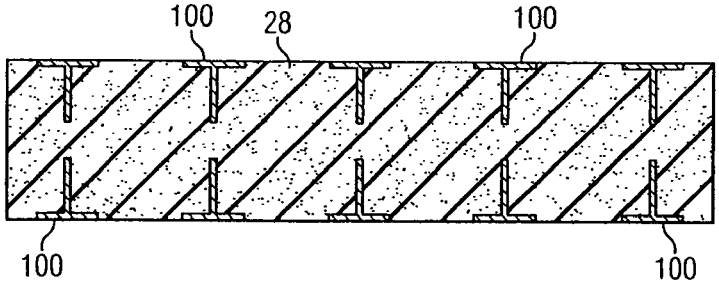

FIG. 10*b* shows "T"-shaped support members 100 disposed in insulating block 28 extending the height of panel 22. Opposing "T"-shaped support members 100 are directly opposite one another, but still do not extend all the way through from the interior surface to the exterior surface of panel 22. In the embodiment of FIG. 10*b*, there is a break or gap between opposing "T" support members 100, the space being filled with foam to block the thermal conduction path from the interior surface to the exterior surface of panel 22. Accordingly, the thermal conduction path through panel 22, attributed to the metal support members, is discontinuous.

Figure 10C:
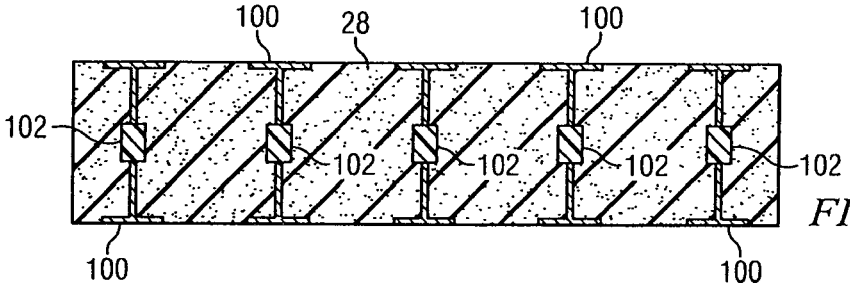

FIG. 10*c* illustrates the "T"-shaped support members 100 of FIG. 10*b* with thermally insulating connectors 102 placed between opposing "T"-shaped support members 100. The thermal insulating connectors 102 are made of plastic or other rigid thermally isolating material. The thermal insulating connectors 102 provide additional strength for the support members 100, while blocking the thermal conduction path from the interior surface to the exterior surface of panel 22. Accordingly, the thermal conduction path through panel 22, attributed to the metal support members, is discontinuous.

Figure 10D:
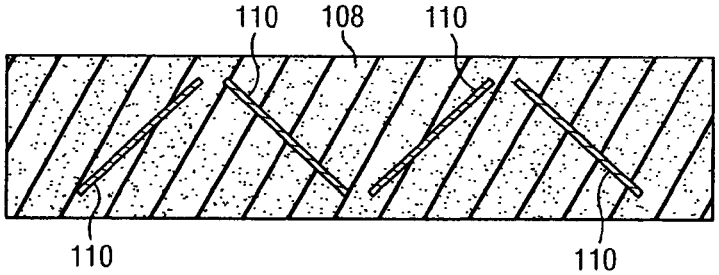

FIG. 10*d* shows straight support members 110 embedded within the interior of insulating material 108. In this embodiment, the panel 22 can be made by creating a form of the outline of the building panel. The support members 110 are placed into the form, and the form is filled with the insulating material 108, e.g., paper, foam, or fiberglass. The insulating material 108 is mixed with an adhesive to create a semi-fluid mixture that surrounds and encases the support members 110 as the form is filled. When the insulating material hardens, the panel forms are removed, leaving panel 22. The support members 110 do not extend all the way through from the interior surface to the exterior surface of panel 22. In the embodiment of FIG. 10*d*, there is a break or gap on either end of the support member 110 before the interior and exterior surfaces of panel 22. The space of the gap is filled with the insulating material 108 to block the thermal conduction path from the interior surface to the exterior surface of panel 22. Accordingly, the thermal conduction path through panel 22, attributed to the metal support members, is discontinuous.

Figure 10E:
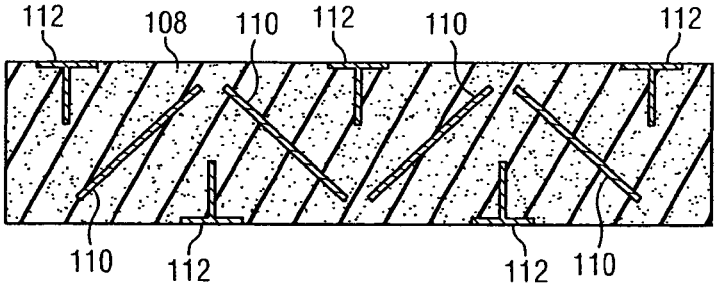

FIG. 10*e* shows straight support members 110 in combination with "T"-shaped support members 112 embedded within the interior of insulating material 108. As with FIG.

10*d*, the panel 22 can be made by creating a form of the outline of the building panel. The support members 110 and 112 are placed into the form, and the form is filled with the insulating material 108 in its semi-fluid state to surround and encase the support members 110 and 112 as the form is filled. When the insulating material hardens, the panel forms are removed, leaving panel 22. The support members 110 and 112 do not extend all the way through from the interior surface to the exterior surface of panel 22, which blocks the thermal conduction path from the interior surface to the exterior surface of panel 22. Accordingly, the thermal conduction path through panel 22, attributed to the metal support members, is discontinuous.

Figure 10F:
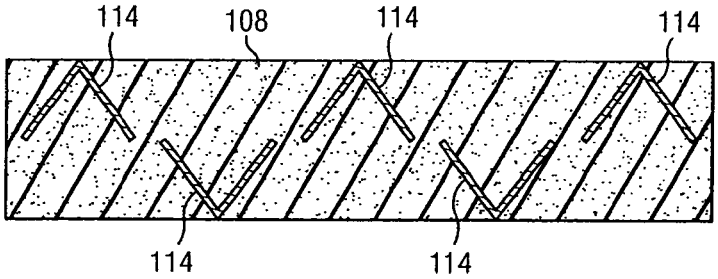

FIG. 10*f* shows angled support members 114 embedded within the interior of insulating material 108. As with FIG. 10*d*, panel 22 can be made by creating a form of the outline of the building panel. The support members 114 are placed into the form, and the form is filled with the insulating material 108. The insulating material 108 is mixed with an adhesive to create a semi-fluid mixture that surrounds and encases the support members 114 as the form is filled. When the insulating material hardens, the panel forms are removed, leaving panel 22. The support members 114 do not extend all the way through from the interior surface to the exterior surface of panel 22. In the embodiment of FIG. 10*f*, there is a break or gap on either end of the support member 114 before the interior and exterior surfaces of panel 22. The space of the gap is filled with the insulating material 108 to block the thermal conduction path from the interior surface to the exterior surface of panel 22. Accordingly, the thermal conduction path through panel 22, attributed to the metal support members, is discontinuous.

Figure 11:
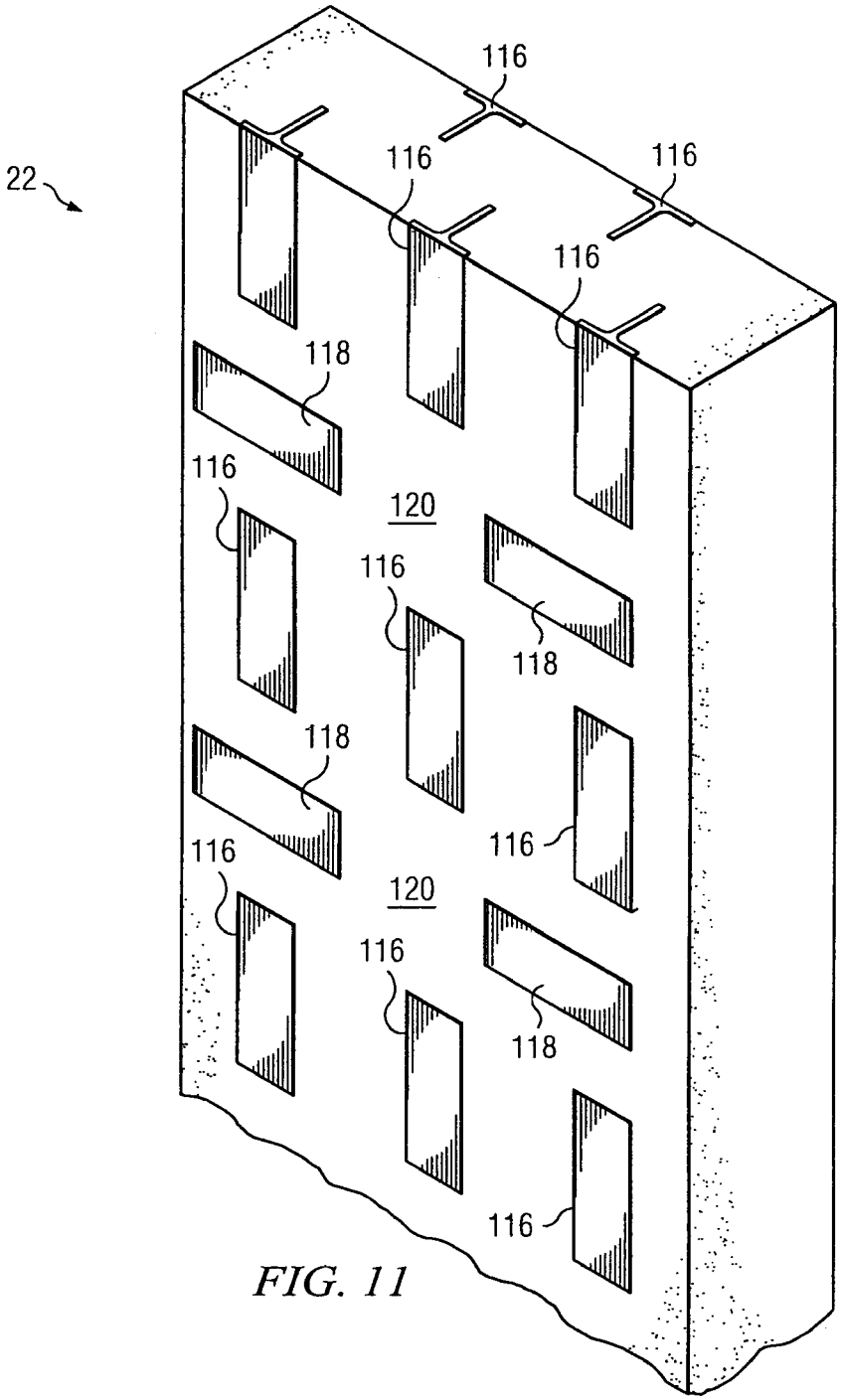
FIG. 11 illustrates the foam-filled panel with support members installed in horizontal and vertical positions.

Another embodiment of panel 22 is shown in FIG. 11. The stem of "T"-shaped support members 116 and 118 extend only partially into the insulating material. However, the support members do not extend the complete height of panel 22. Instead, panel 22 has a row of vertical support members 116, followed by a row of horizontal support members 118, followed by a row of vertical support members 116, and another row of horizontal support members 118, and so on. In areas 120, there are horizontal support members 118 on the opposite surface of panel 22.

Figure 12A:
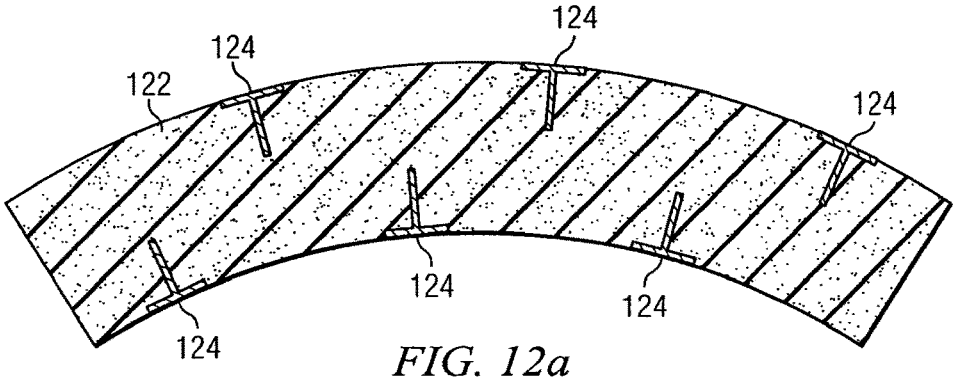
FIGS. 12*a*-12*b* illustrate alternative shapes for the foam-filled panel with support members.
Figure 12B:
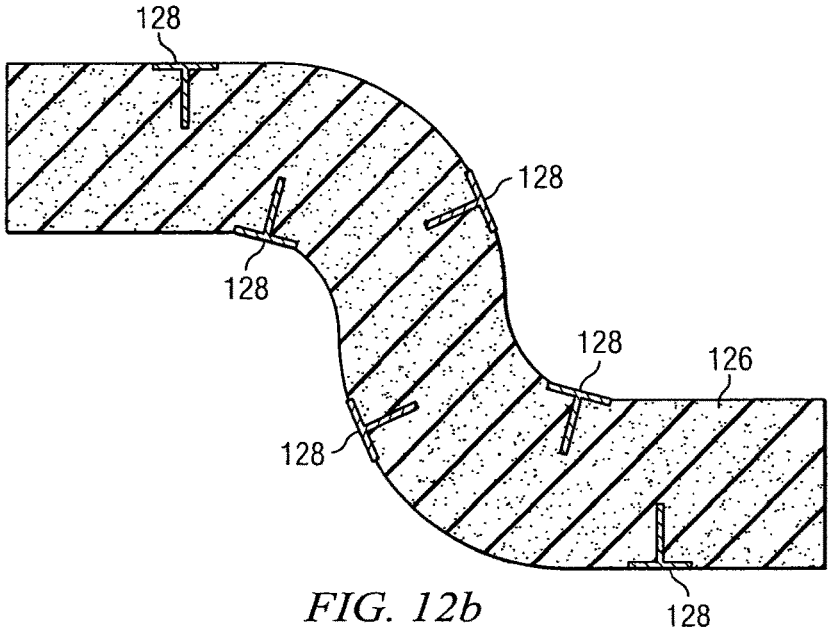

Wall panel 22 can be formed with horizontal and vertical conduits or air channels to run electric wire and plumbing pipes. Doors and windows can be cut into wall panel 22 in the manufacturing facility or at the construction site. The wall panel can be formed to any shape. FIG. 12*a* shows a curved wall panel 122 with "T" support members 124. FIG. 12*b* shows an "S" shaped wall panel 126 with "T" support members 128.

Roof panels for the building structure 20 can be manufactured as described for building panel 22. The same is true for floor and ceiling panels. Since roof panels rest at an angle or flat, these panels may include additional support for vertical loads bearing into the surface of the panel.

Figure 13:
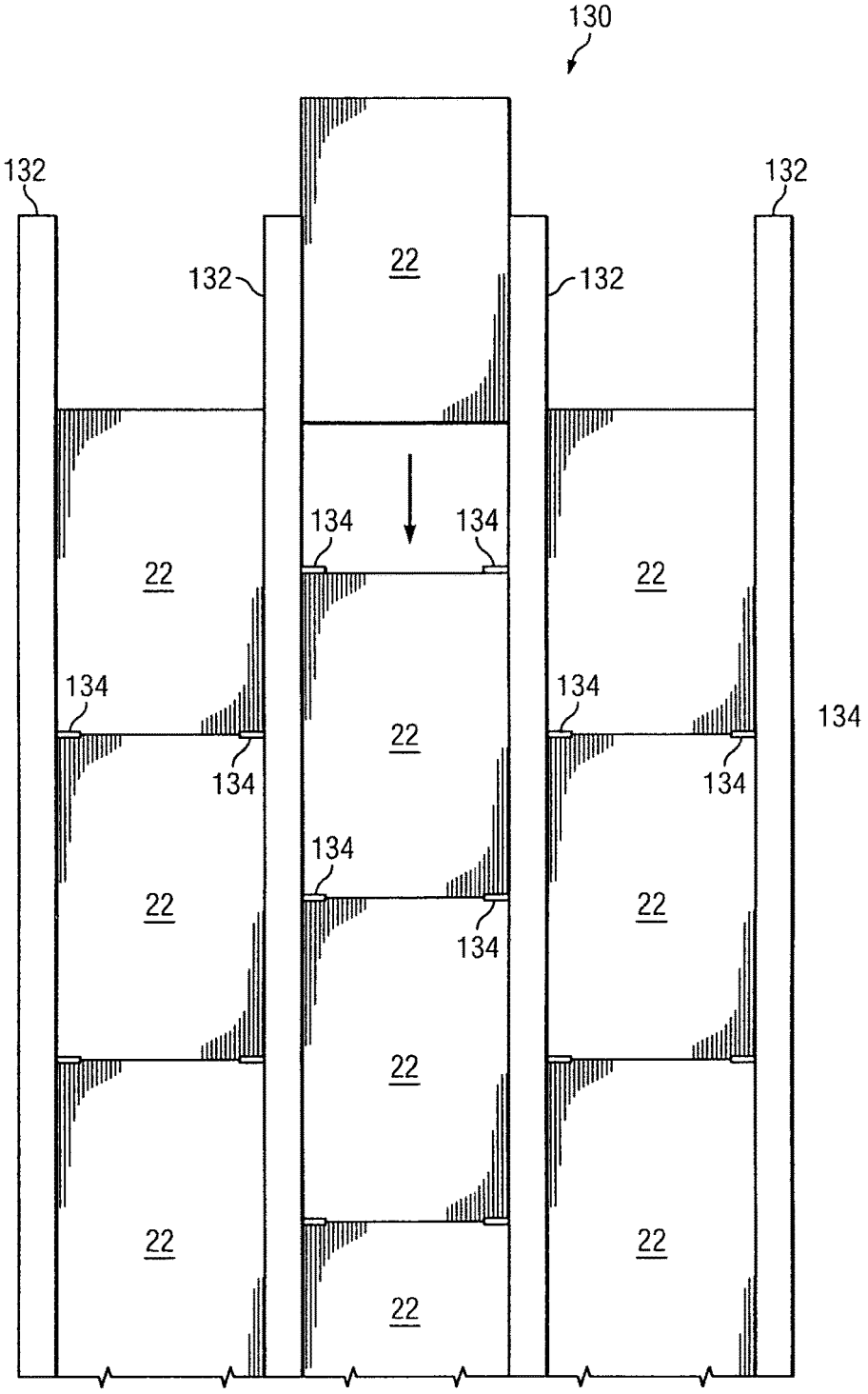
FIG. 13 illustrates the use of foam-filled panels in high-rise buildings between frame columns.

Another application for panel 22 involves high-rise construction. Most high-rise buildings have a frame structure with curtain wall panels placed between columns of the frame structure. Building panels like 22 are ideally suited to be disposed between the frame structure of a high-rise building. In FIG. 13, frame structure 130 has columns 132 made of red iron or steel. Curtain wall panels 22 are placed between columns 132 and rest on ears 134 or are pinned to columns 132. Once in position, curtain wall panels 22 are welded to columns 132. The curtain wall panel has an exterior surface that can be covered with mesh, STO (insulation and finish systems), DENSGLASS (fiberglass mat gypsum panels), and an exposure surface such as stucco, granite, brick, or slate. The interior surface of the curtain wall panel has SHEETROCK (gypsum panels) and decorative covering such as paint or wall paper. Curtain wall panel 22 can be formed with horizontal and vertical conduits or air channels or chases to run electric wire and plumbing pipes. Alternatively, foam-filled panel 22 can be formed within another panel that acts as the curtain wall panel. The electric and plumbing lines can be placed in gaps between the curtain wall panel and the inner foam-filled panel 22.

Panels like 22 have applications in many other industries, such as aircraft fuselage, automobile bodies, and marine hulls. The panels are strong, exhibit high thermal insulation properties, and can be formed to any size and shape, which would be well-suited to such applications.

Figure 14:
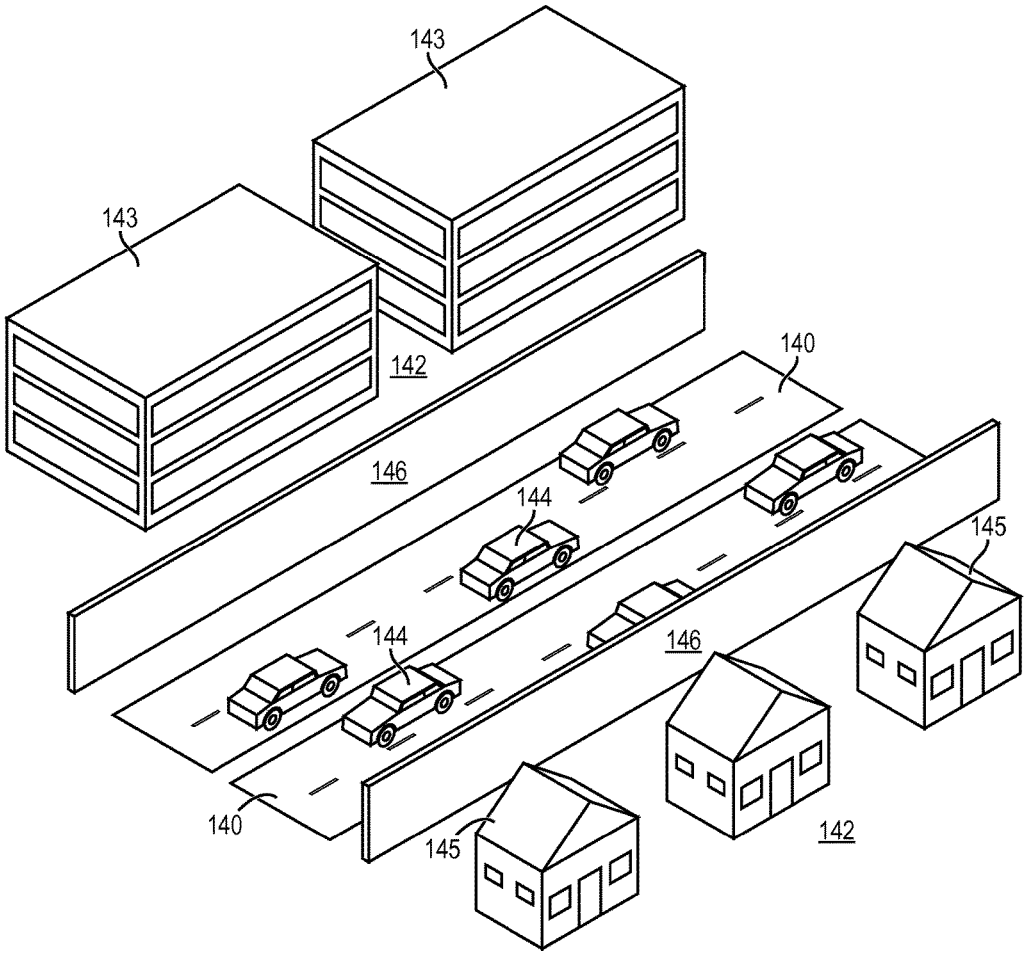
FIG. 14 illustrates a barrier wall along a roadway adjacent to residential or commercial area.

In another embodiment, FIG. 14 shows a roadway 140 with surrounding residential neighborhoods or commercial areas 142 with buildings 143 and homes 145. For example, roadway 140 can be an interstate freeway or main transportation link. Automobiles, trucks, motorcycles, and other traffic 144 traverse roadway 140, typically at high speed and at times high volume. Traffic 144 creates considerable noise from engines turning at high RPM and tires rolling over the asphalt at high speed. The noise can be disruptive and annoying to the people occupying areas 142. In addition, roadway 140 presents a safety hazard to the people in areas 142. Children may try to cross roadway 140, not considering or appreciating the danger. Domestic animals may wander onto roadway 140. People typically do not want to live or work in areas 142, adjacent to a busy and noisy roadway.

To minimize the impact of the noise and safety hazard, barrier walls 146 are constructed along roadway 140. Barrier walls 146 typically have a height of 10-30 feet and can extend considerable distance, from hundreds of feet to miles in length. Barrier walls 146 absorb or deflect the noise generated by traffic 144 to abate its impact into areas 142. Barrier walls 146 also restrict access to roadway 140 to block or inhibit pedestrians, animals, and other objects from gaining access to the roadway. Barrier wall 146 serves to maintain property value and enable quiet enjoyment of areas 142 adjacent to roadway 140. Barrier wall 146 has other applications, such as a retaining wall, security wall, privacy wall, etc.

Figure 15A:
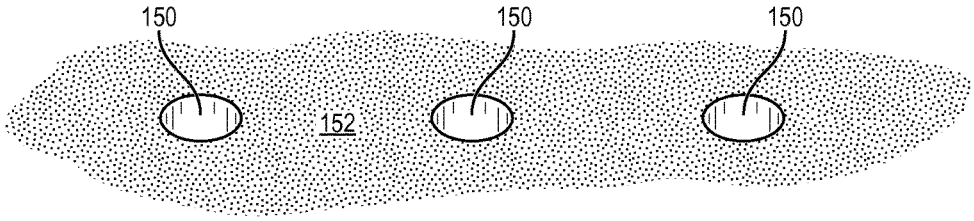
FIGS. 15*a*-15*t* illustrate a process of forming a barrier wall over footings using wall panels disposed between wall stiffeners.
Figure 15B:
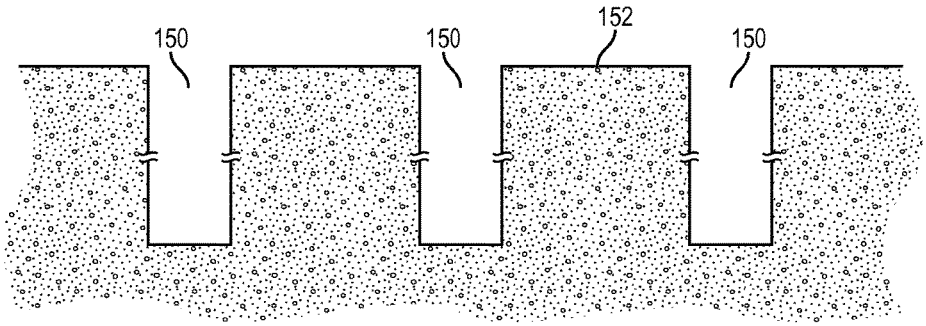
Figure 15C:
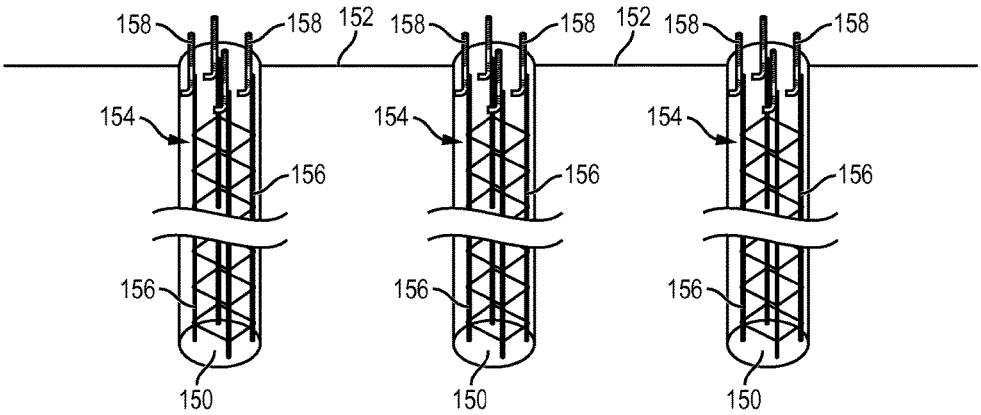
Figure 15D:
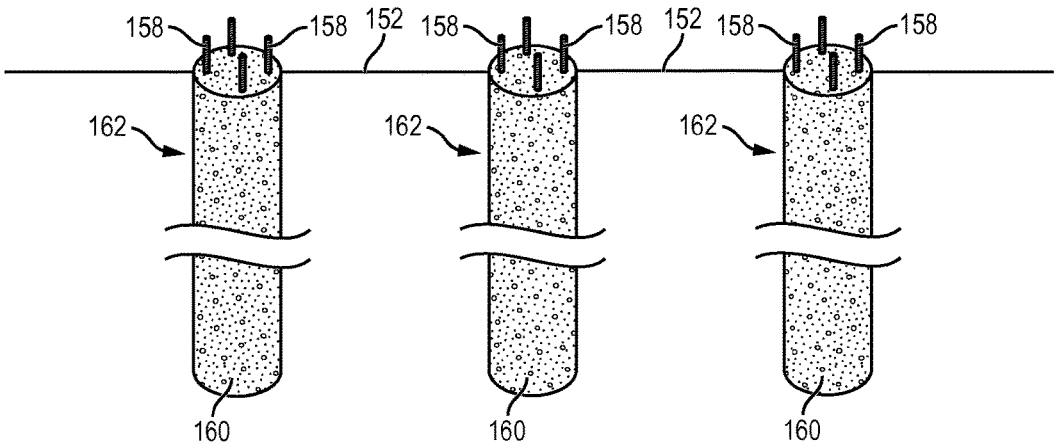

To construct barrier wall 146, a plurality of footing holes 150 is drilled into earth 152 down to a solid base or foundation, as shown in FIGS. 15*a*-15*b*. In one embodiment, footing holes 150 has a width or diameter of 24-36 inches and depth of 7-19 feet, depending on the height of barrier wall 146 and ground conditions. Footing holes 150 are spaced about 15-20 feet apart. In FIG. 15*c*, a rebar structure 154 is formed within footing holes 150. Rebar structure 154 includes a plurality of rebar rods 156 tied together with wire. A plurality of "L"-shaped bolts 158 are tied to rebar structure 154 with the threaded end of the bolts extending above ground level 152. The "L"-shaped bolts 158 may have a length of 12-24 inches. In FIG. 15*d*, concrete 160 is poured into footing holes 150 to cover rebar structure 154 and form footings 162. The threaded end of bolts 158 extend above the surface of footings 162. Footings 162 are easy to form and require less concrete than a conventional concrete wall.

Figure 15F:
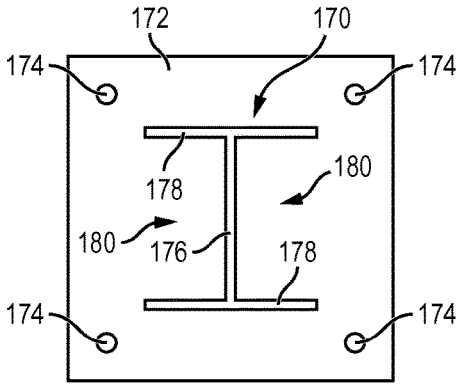
Figure 15E:
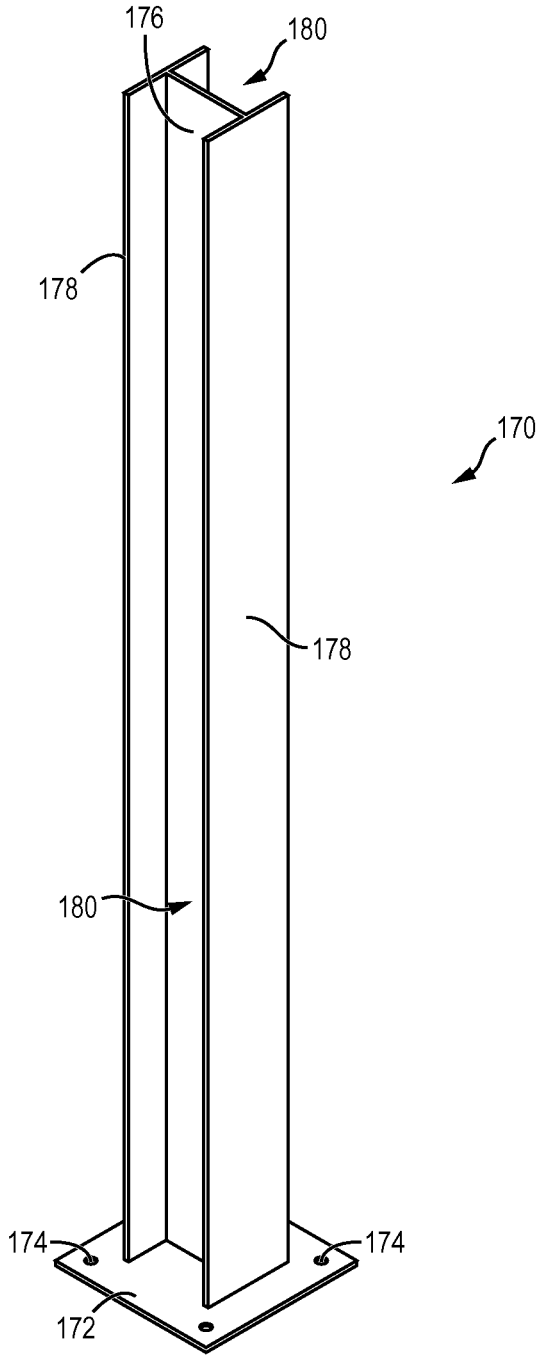

FIG. 15*e* shows a vertical wall stiffener 170 with base plate 172 containing a plurality of holes 174. Wall stiffener 170 can be welded, bolted, or otherwise secured to base plate 172 by suitable high-strength attachment mechanism. Wall stiffener 170 can be 18-20 gauge hot-dipped galvanized steel for rust prevention. Base plate 172 can have a length and width ranging from 14-24 inches and thickness of 1.0-1.75 inches. Wall stiffener 170 has "I" beam configuration with center plate 176, side plates 178, and areas 180 inside the "I" beam structure, as shown in the top view of FIG. 15*f*. The height of vertical wall stiffeners 170 is substantially equal to the height of barrier wall 146. In one embodiment, vertical wall stiffeners 170 have a height of 10-30 feet. Additional "I" beams can be bolted or welded to vertical wall stiffeners 170 as needed to obtain the requisite height of barrier wall 146.

Figure 15G:
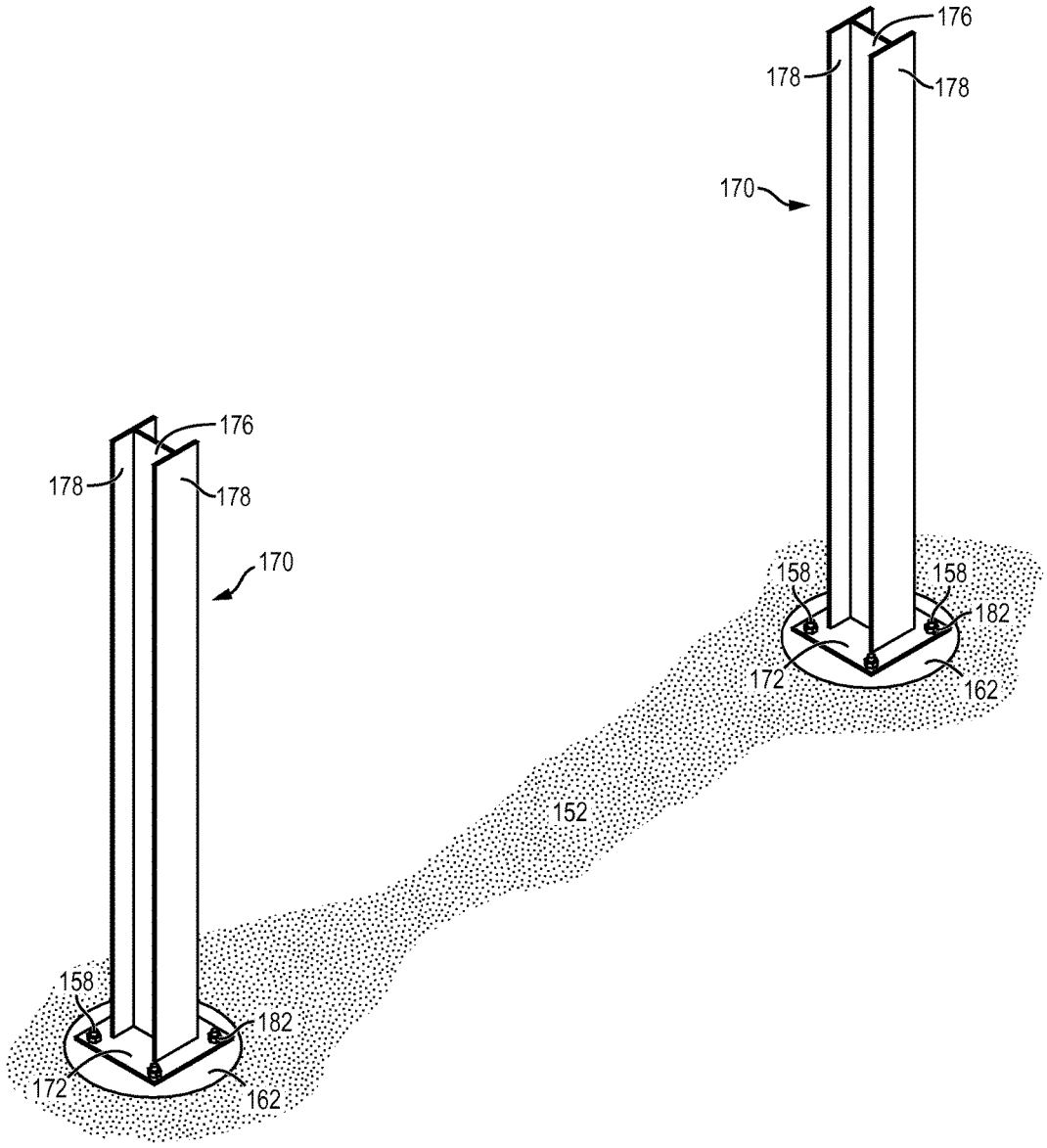
Figure 15H:
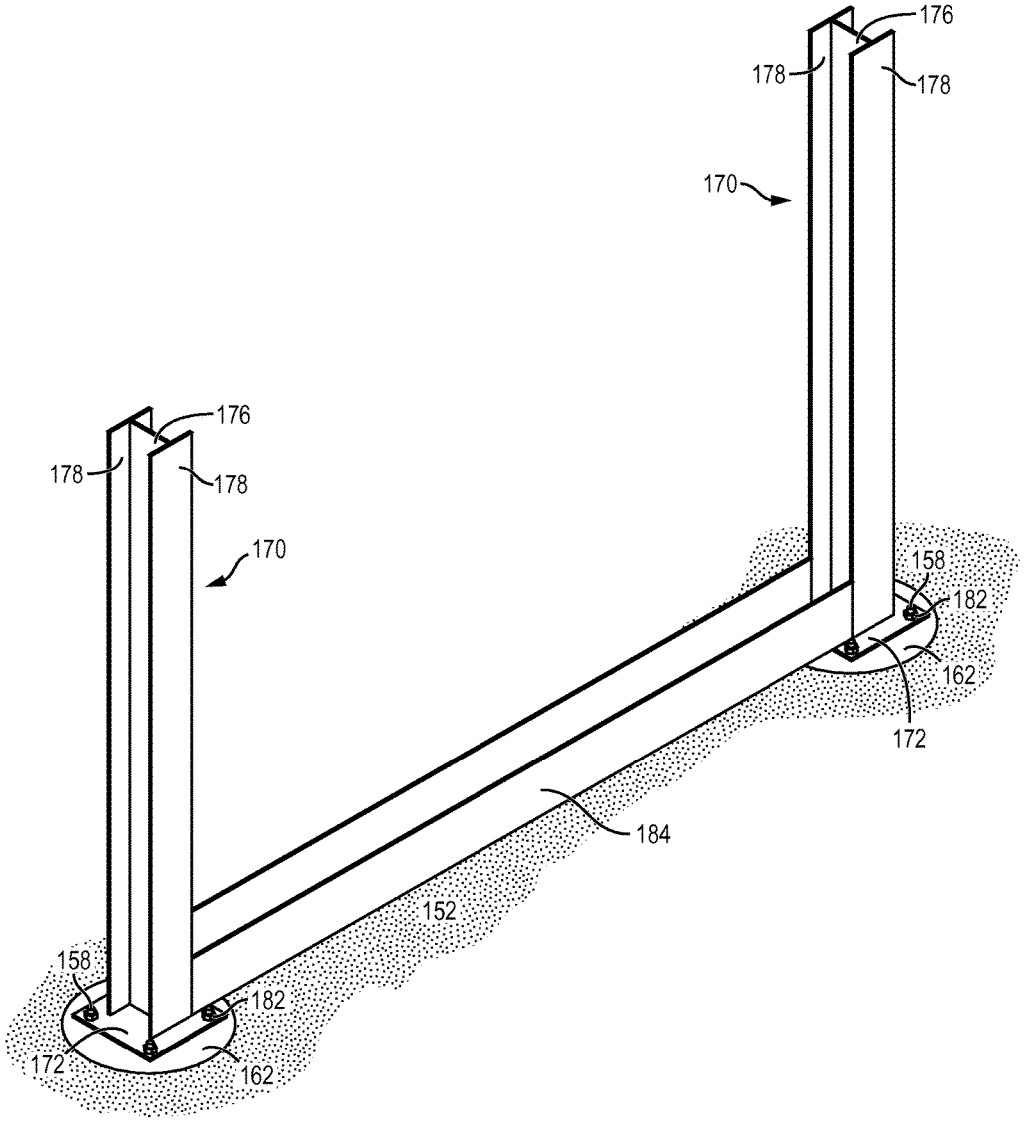

In FIG. 15*g*, a plurality of vertical wall stiffeners 170 is mounted to footings 162 by placing bolts 158 through holes 174 in base plate 172. Nuts 182 are screwed onto bolts 158 to securely hold wall stiffeners 170 to footings 162 under load. Wall stiffeners 170 are spaced about 15-20 feet apart for convenient elevation breaks in ground level 152. In FIG. 15*h*, an optional "U"-shaped horizontal wall stiffener 184 is placed between adjacent vertical wall stiffeners 170 to support wall panels 190 across the span between the vertical wall stiffeners.

Figure 15I:
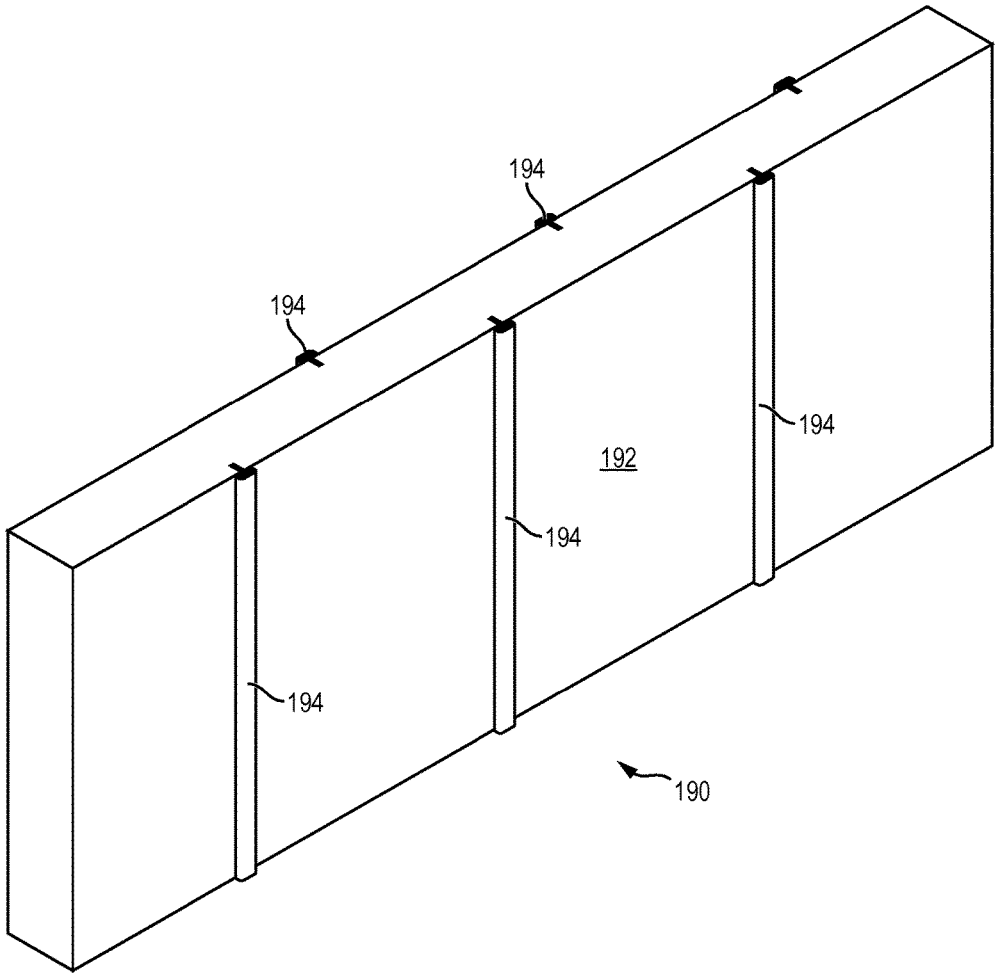

FIG. 15*i* shows a wall panel 190 designated for placement between wall stiffeners 170. Wall panel 190 includes one or more sound insulating blocks 192 each with length of 8-10 feet, height of 3-4 feet, and thickness ranging from 8-12 inches. The insulating blocks 192 may be made with EPS foam, fiberglass, paper, or any other light-weight, durable material suitable for blocking or deflecting sound.

A plurality of support members or struts 194 is inserted into insulating blocks 190 to provide structural support and withstand the environmental elements, e.g., wind, rain, and snow. Support member 194 can be made from a variety of materials capable of providing structural support with insulating blocks 192, such materials including metal (steel, aluminum or composite metal), ceramic, fiberglass, graphite, wood, plastic, rubber, and composites of such materials. In one embodiment, support members 194 are formed in the shape of a "T" and run from a top surface to a bottom surface of insulating block 192. Support members 194 are constructed with a head portion and stem portion, similar to FIG. 3. The stem portion of support member 194 extends partially into insulating block 192. In one embodiment, support member 194 extends about half way through insulating block 192. The support members 194 are installed on opposite sides of insulating block 192, in an alternating pattern and offset or staggered with respect to the adjacent support members on the other side of the insulating block. The support members are about 12-18 inches apart on center of each member, and about 24-36 inches apart on each side of insulating block 192.

A groove or slot is cut into a side surface from the bottom to the top of insulating blocks 192 to a depth at least the length of the stem portion of support member 194, similar to FIG. 6. An adhesive such as urethane glue is deposited into the groove. The stem portion of support members 194 is then inserted into the groove until the head portion contacts the surface of insulating block 192. The adhesive cures and forms a secure union between support member 194 and insulating block 192.

In another embodiment, a shallow trench or recess is cut into insulating block 192 to sufficient depth to contain the head portion of support member 194, similar to FIG. 7. In addition, a groove or slot is cut to a depth at least the length of the stem portion of support member 194. An adhesive is deposited into the groove and shallow recess. The stem portion is inserted into the groove and the head portion into the shallow trench so that the top surface of the head portion is co-planar with the surface of insulating blocks 192 and provides a flush surface for wall panel 190. The adhesive cures and forms a secure union between support member 194 and insulating block 192.

In another embodiment, support member 194 has an "L"-shape with a head portion and stem portion, similar to FIG. 8. A shallow trench or recess is cut into insulating block 192 to sufficient depth to contain the head portion. In addition, a groove or slot is cut to a depth at least the length of the stem portion of support member 194. An adhesive is deposited into the groove and shallow recess. The stem portion of support member 194 is then inserted into the groove until the top surface of the head portion is co-planar with the surface of insulating blocks 192. The recessed head portion provides a flush surface for wall panel 190. The adhesive cures and forms a secure union between support member 194 and insulating block 192.

A combination of "T"-shaped support member and "L"-shaped support members can be inserted into insulating blocks 192. Support members 194 can also be arranged in a similar manner as shown in FIGS. 10*a*-10*f*.

Figure 15J:
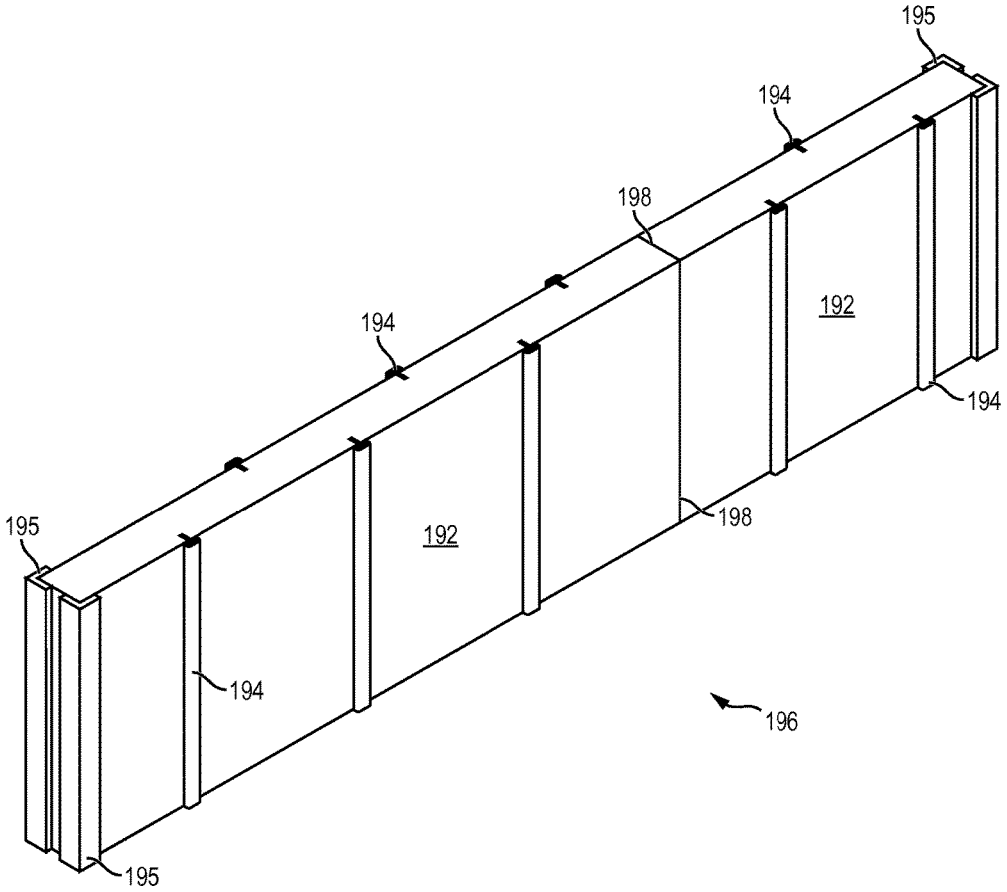

In FIG. 15*j*, two or more wall panels 190 can be joined end-to-end to form composite wall panel 196 which spans between wall stiffeners 170. The adjacent wall panels 190 are bonded together at joint 198 between insulating blocks 192 with an adhesive, such as urethane glue. Wall panel 196 may have top, bottom, and/or side end caps 195 for support and protection of insulating block 192. The top, bottom, and side end cap 195 is a metal angle or "L"-shaped brace running along the perimeter of insulating block 192, contacting the top, bottom, and/or sides of the insulating blocks.

Figure 15K:
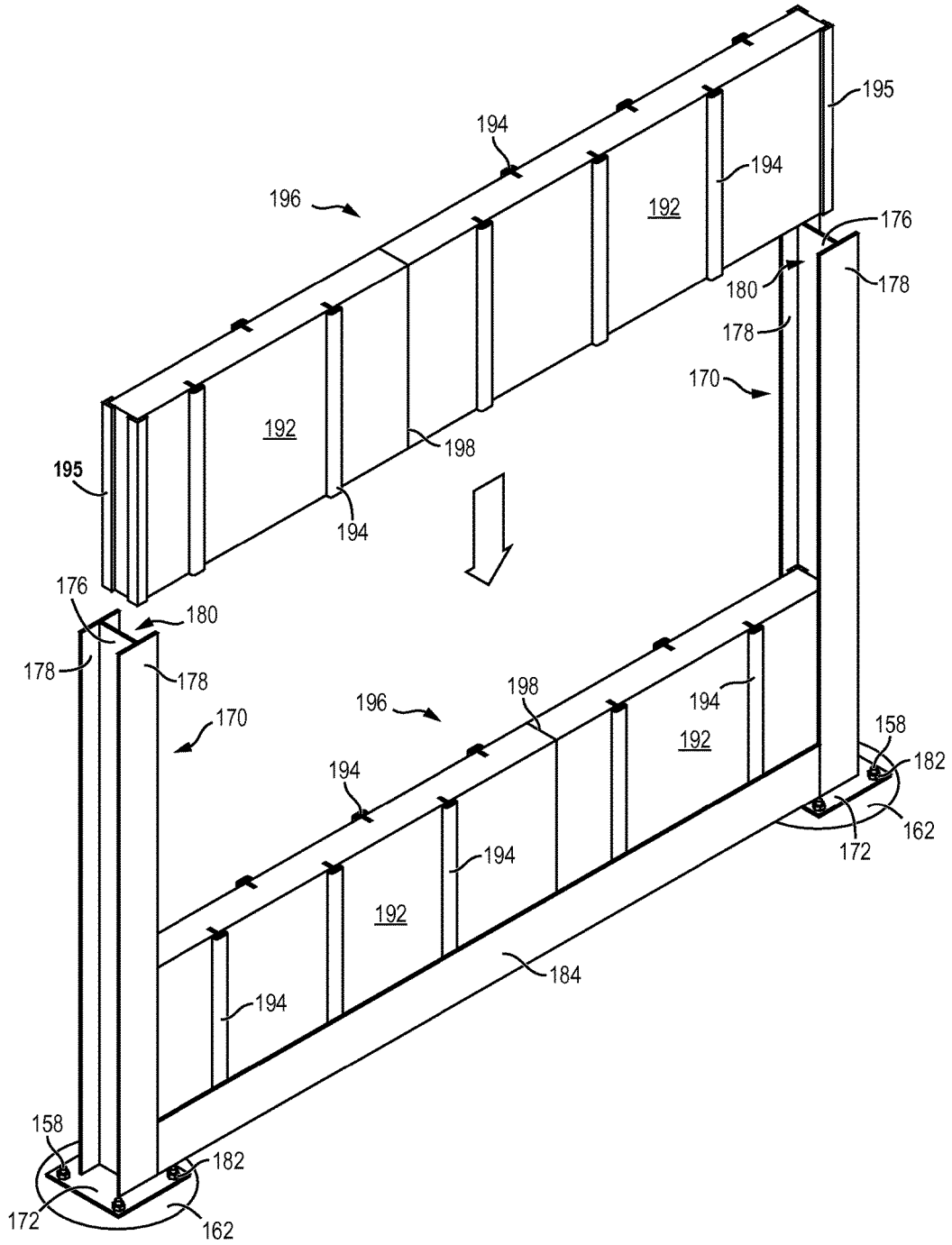

FIG. 15*k* shows wall panels 196 placed into inside areas 180 between side plates 178 of wall stiffeners 170. The first wall panel 196 can be inserted into "U"-shaped horizontal wall stiffener 184. Additional wall panels 196 are vertically stacked, one-by-one, over the first wall panel 196. The top surface of one wall panel 196 can be bonded to the bottom surface of the next level wall panel with an adhesive, such as urethane glue.

Figure 15L:
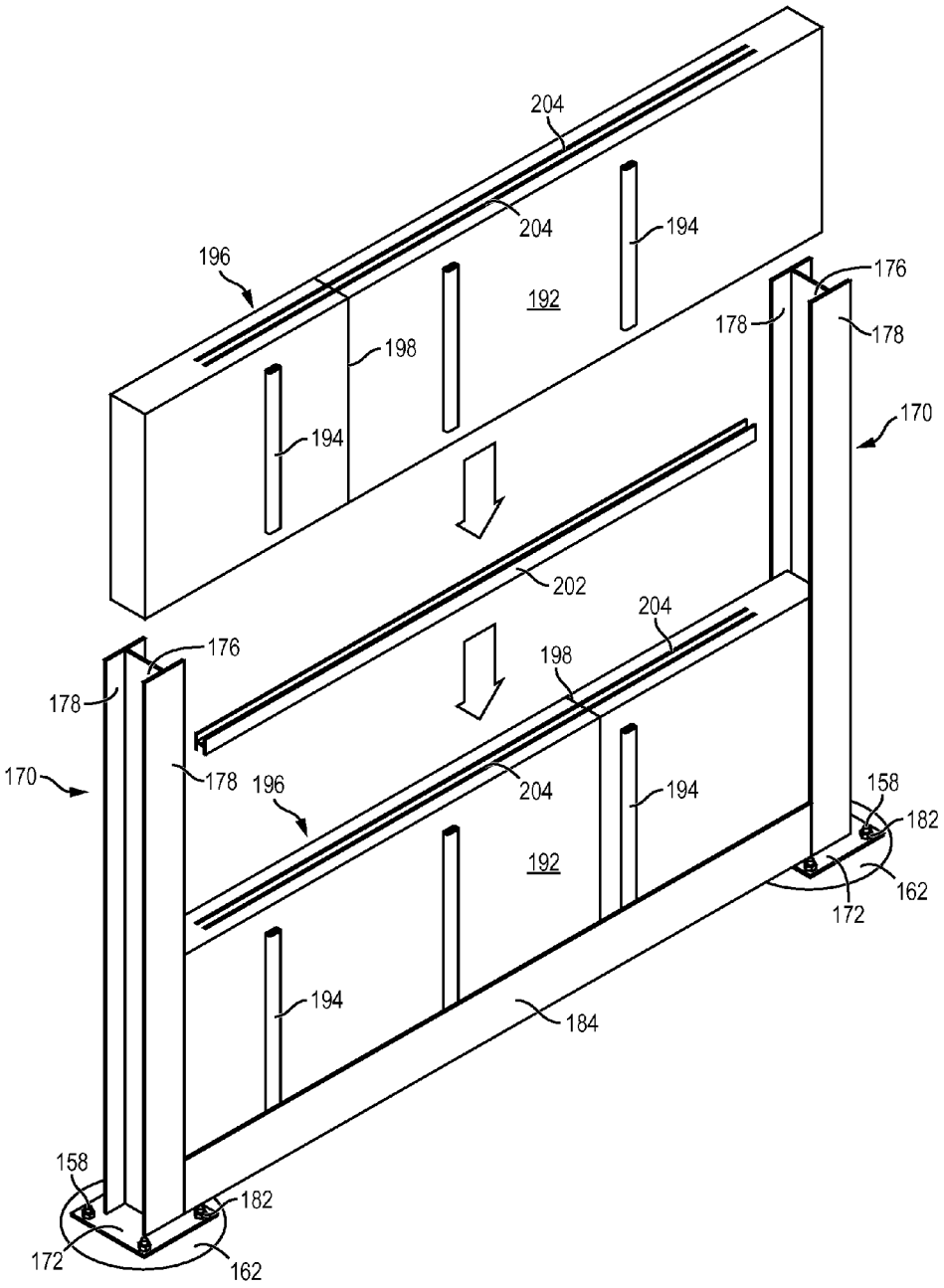
Figure 15M:
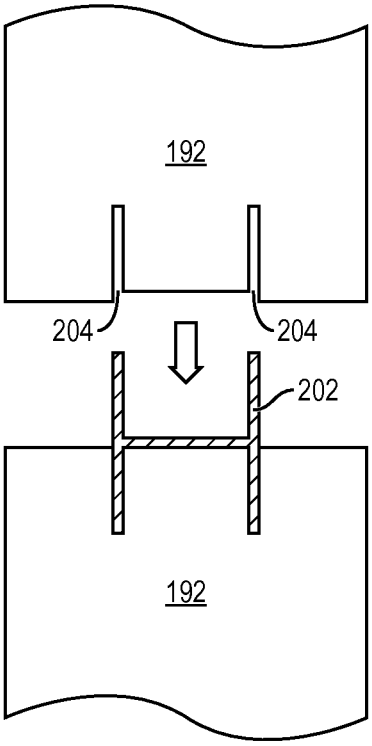
Figure 15N:
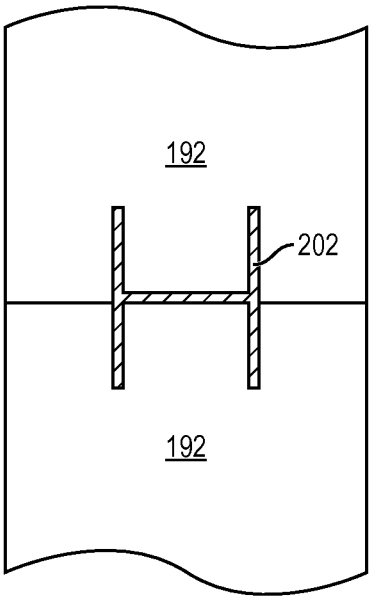

In an alternative embodiment, an "I" beam 202 can be placed in grooves or slots 204 formed in a top surface of insulating blocks 192 of wall panel 196, as shown in FIG. 15*l*. In this case, support member 194 may not extend to the top and bottom surfaces of insulating block 192 in order to make room for "I" beam 202. The bottom surface of the next level wall panel 196 has corresponding grooves or slots 204, as shown in the side view of FIG. 15*m*. An adhesive is deposited into grooves 204 of both wall panels 196. In the side view of FIG. 15*n*, the "I" beam 202 is inserted into grooves 204 of the next level wall panel 196 and the adhesive is cured to securely bond the stacked wall panels.

Figure 15O:
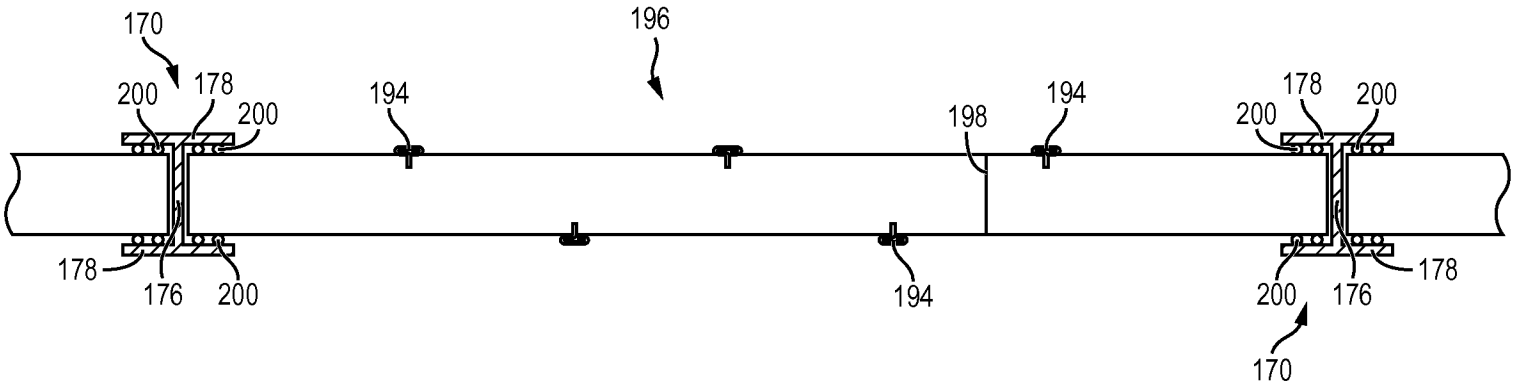

FIG. 15*o* shows a top view of wall panels 196 placed into inside areas 180 between side plates 178 of wall stiffeners 170. A stress relief material 200 can be placed between wall panel 196 and side plate 178 to permit movement between the wall panel and vertical wall stiffener 170.

Figure 15P:
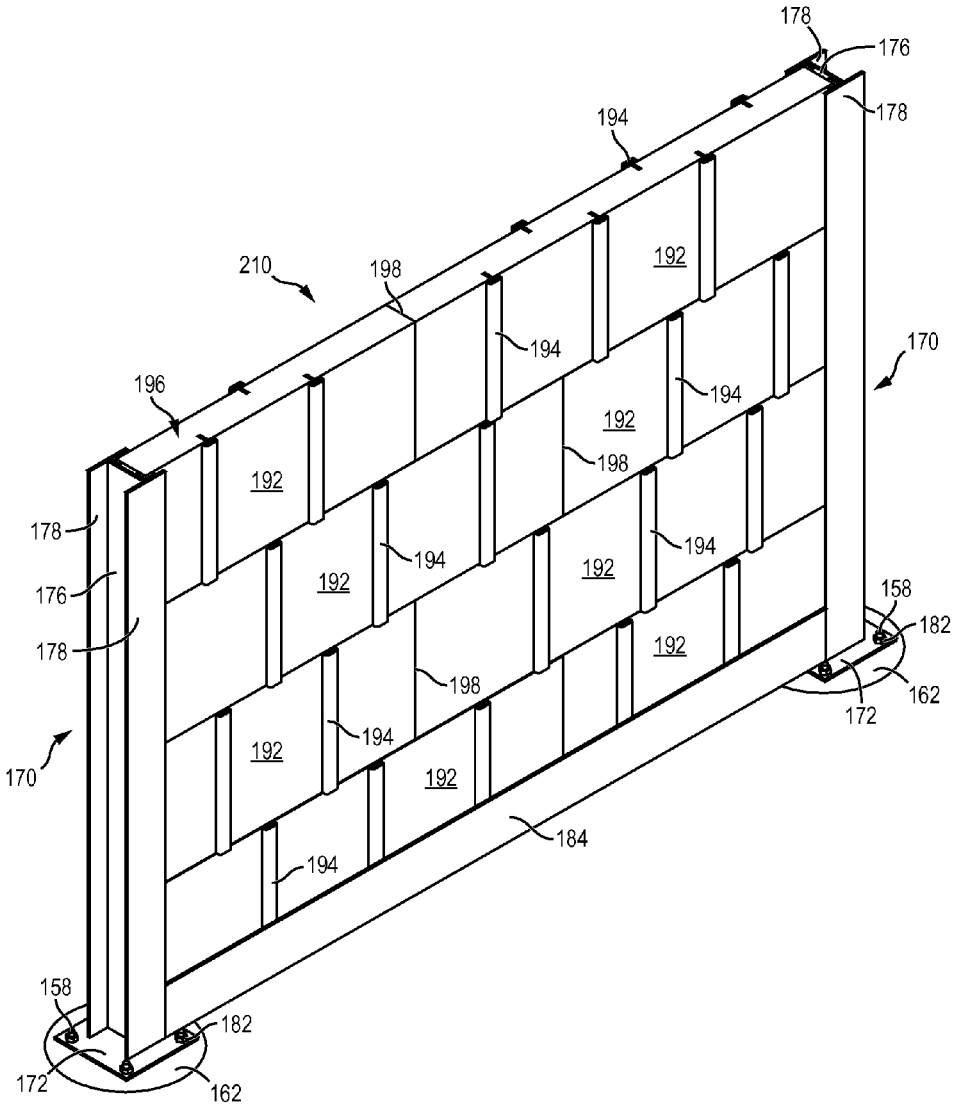
Figure 15Q:
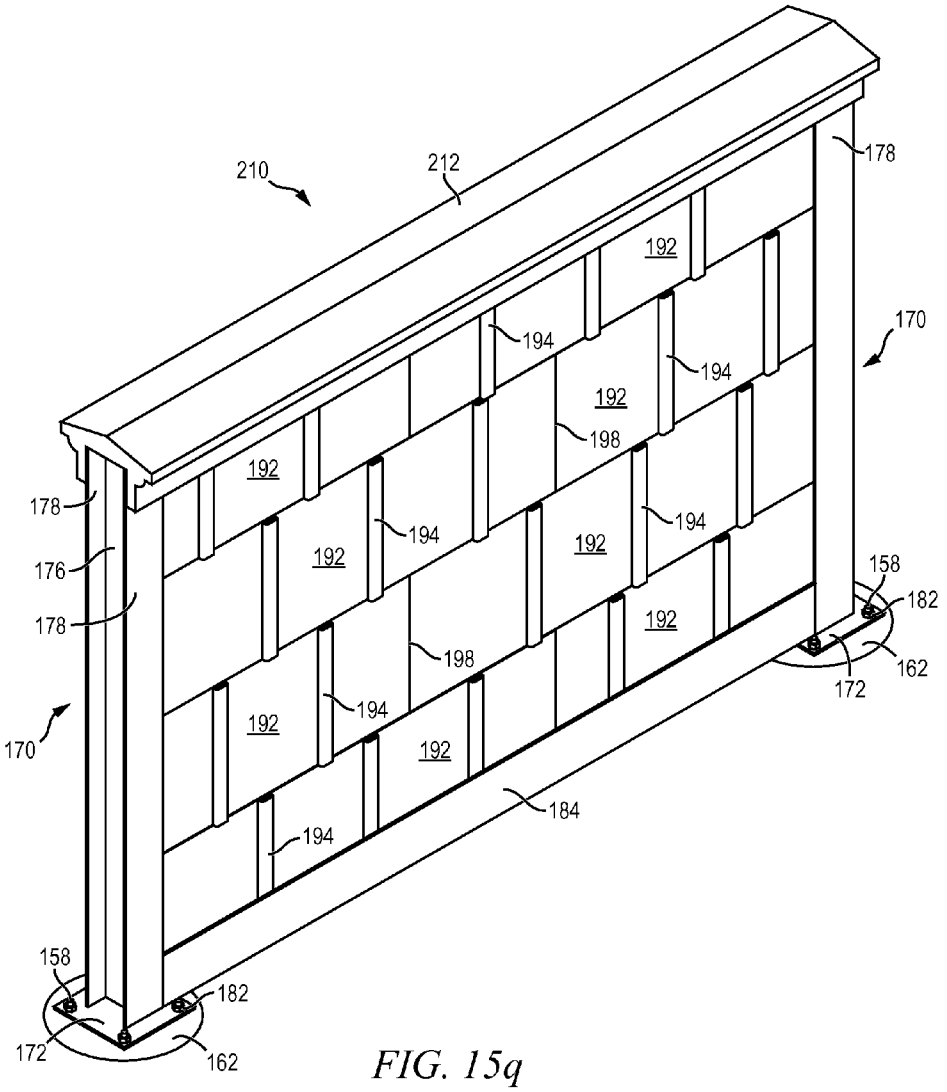
Figure 15R:
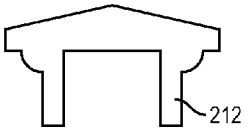
Figure 15S:
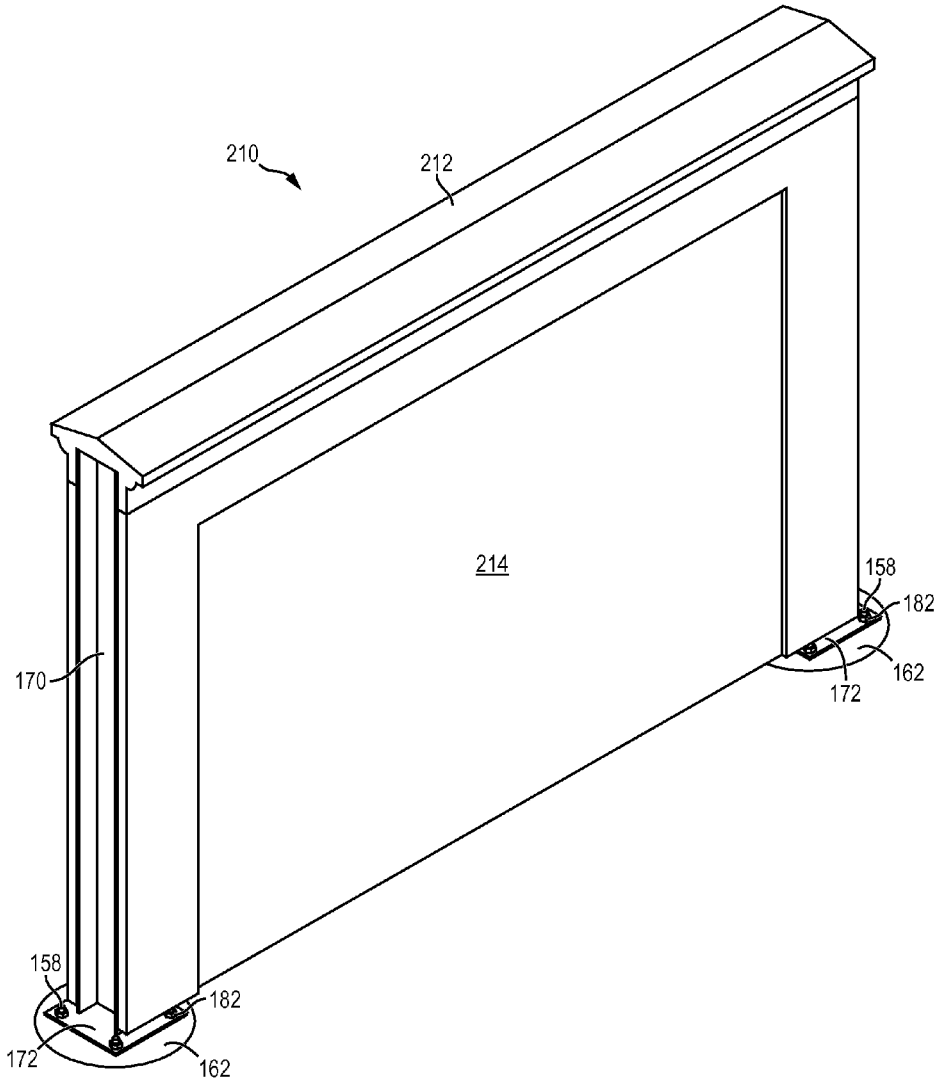
Figure 15T:
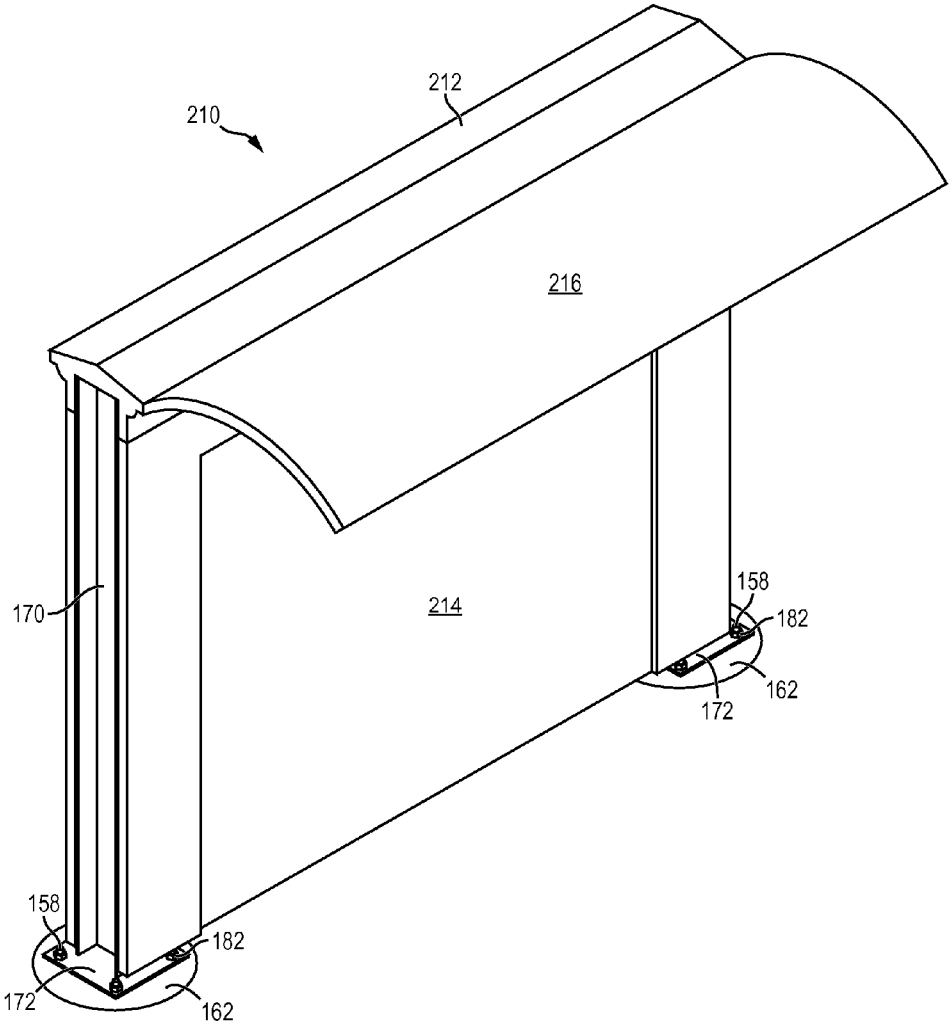

FIG. 15*p* shows one barrier wall section 210 with wall panels 196 stacked between wall stiffeners 170 to a height of barrier wall 146. Any joints 198 can be offset between adjacent stacked wall panels 196. In FIG. 15*q*, a top cap 212 is formed over barrier wall section 210 for structural support. FIG. 15*r* is an end view of top cap 212. In FIG. 15*s*, an external protective layer 214 is formed over wall stiffeners 170 and wall panels 190. Top cap 212 and protective layer 214 can be one or more coatings of STO (insulation and finish systems), stucco, fiberglass, or other weatherproof material for aesthetic appearance and environmental protection from outside elements, such as wind, rain, dust, and smog. The color options in stucco and fiberglass reduce the need for painting. In FIG. 15*t*, a deflector 216 can be integrated onto top cap 212 and extended out 2-4 feet from barrier wall section 210 to deflect sound away from areas 142.

Figure 16:
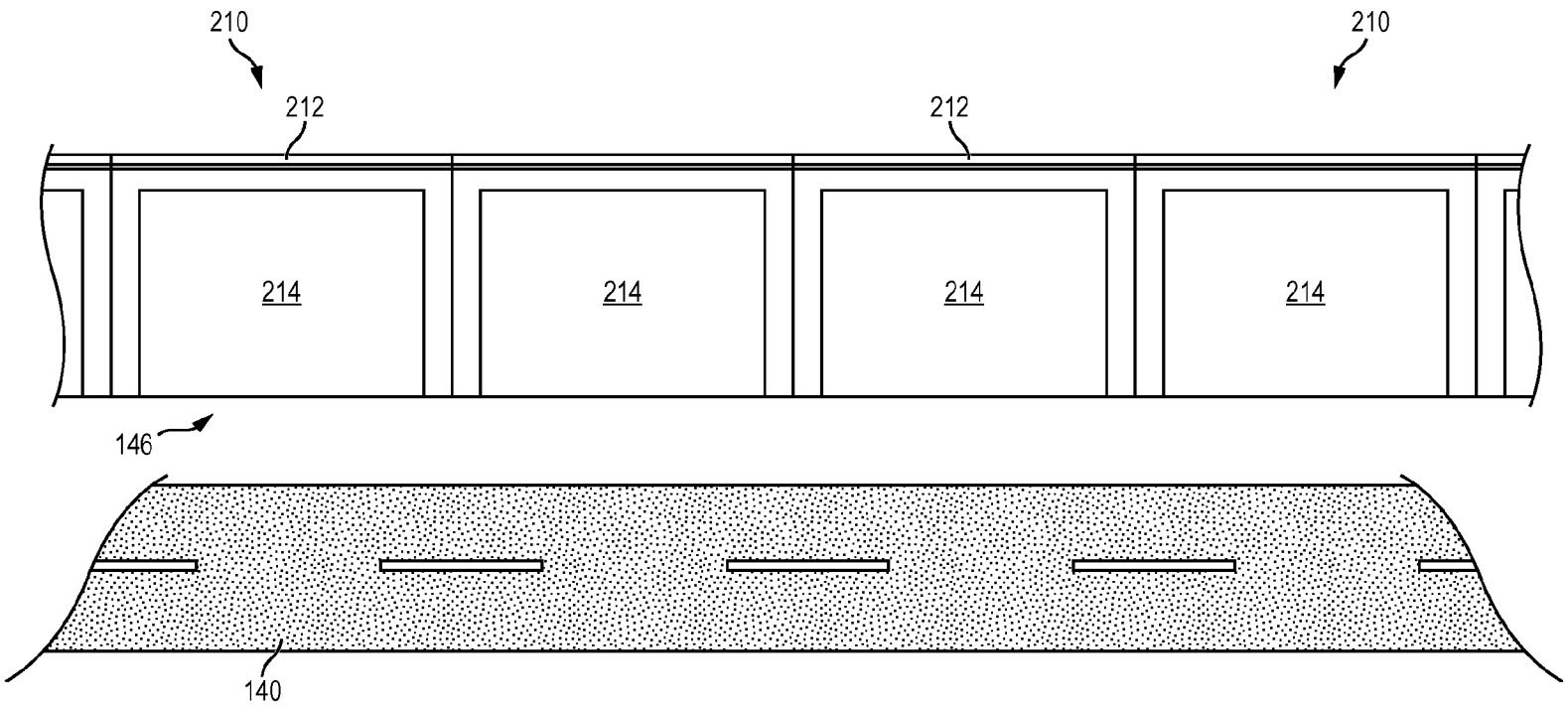
FIG. 16 illustrates the barrier wall formed over the footings using wall panels disposed between wall stiffeners.

FIG. 16 shows a plurality of wall sections 210 extending the length of barrier wall 146. Barrier wall 146 provides a sound barrier between roadway 140 and residential or commercial areas 142, in part due to the sound insulating blocks 192. Barrier wall 146 is easy and cost effective to construct as wall stiffeners 170 and wall panels 196 can be formed off-site, in a controlled environment such as a manufacturing facility, and then transported to and assembled at the job site. The off-site manufacturing provides cost saving efficiencies in terms of accessibility to mass production equipment, sheltered work environment, and ready access to raw materials. Barrier wall 146 is strong, light-weight, and durable due to the arrangement of support members 194 disposed in sound insulating blocks 192. Barrier wall 146 is resistant to water, power-washing, mold, mildew, insects, fire, hurricanes, and earthquakes.

Figure 17A:
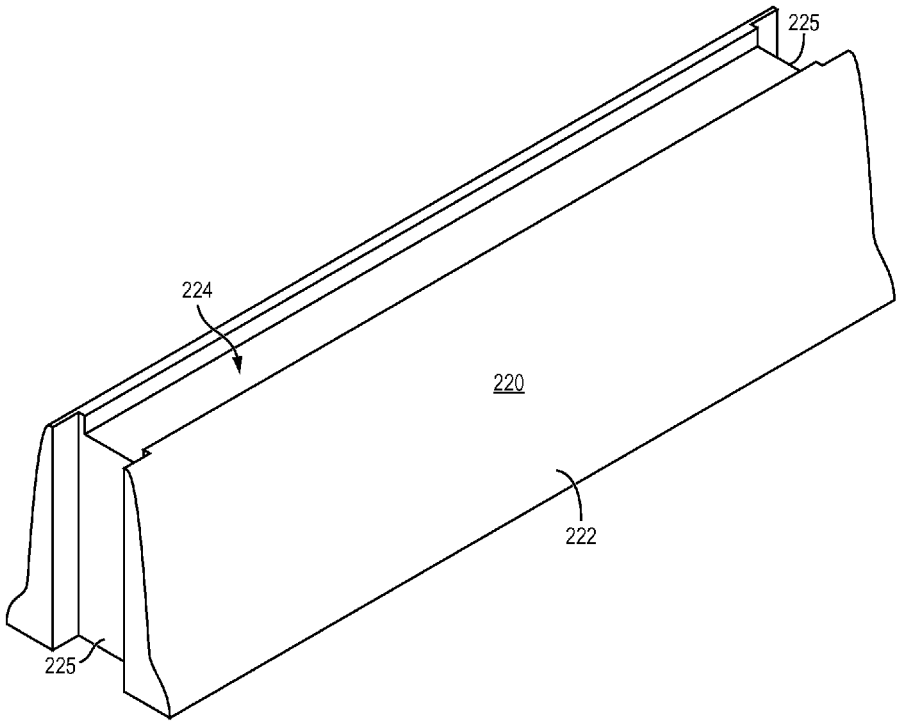
FIGS. 17*a*-17*e* illustrate a process of forming a barrier wall over a crash barrier using wall panels disposed between wall stiffeners.
Figure 17B:
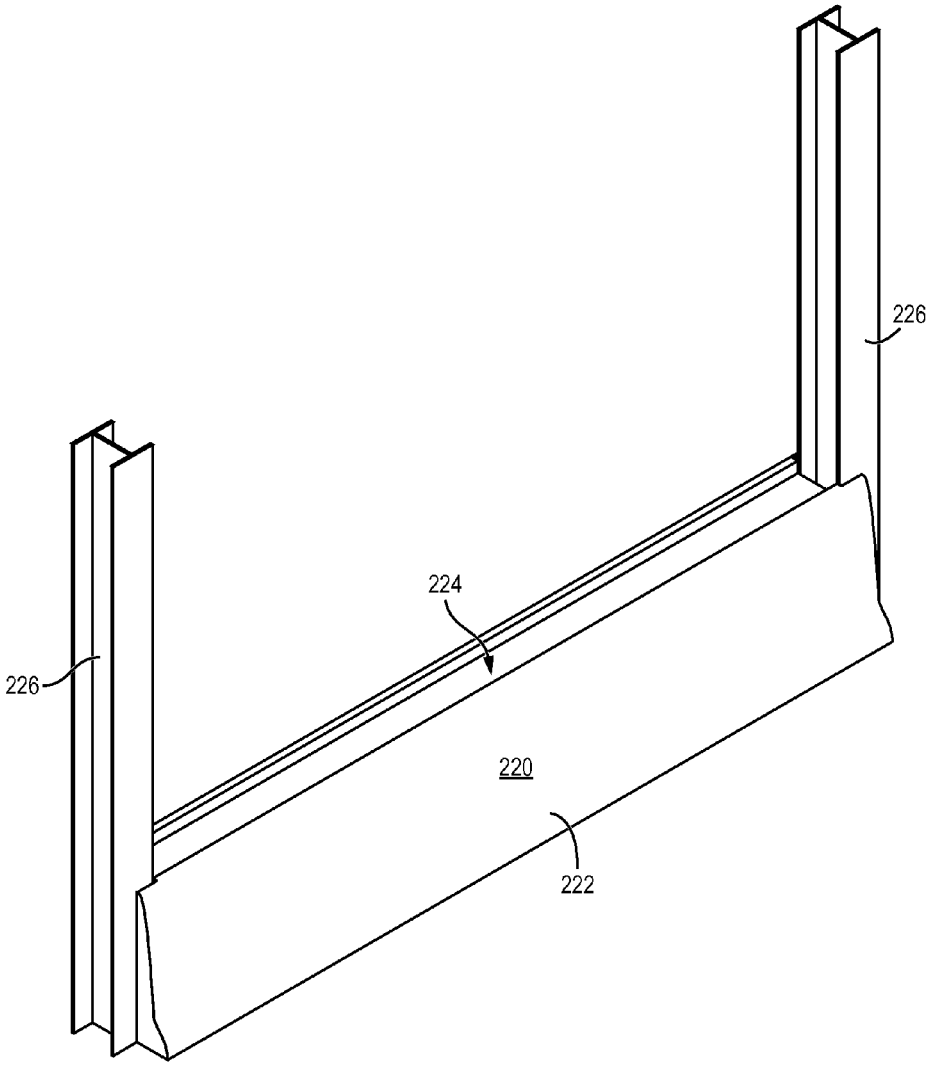

FIG. 17*a* shows another embodiment of the barrier wall with crash barrier 220 having bottom base 222 and slot 224 formed in a top surface and slot 225 formed in a side surface of the crash barrier. Crash barrier 220 is placed along roadway 140, particularly in dangerous areas to prevent vehicles 144 from crossing into another lane or running off the roadway. In FIG. 17*b*, a plurality of wall stiffeners 226 is bolted along slot 225 of crash barrier 220. Wall stiffeners 226 have "I" beam configuration with center plate, side plates, and inside areas, similar to FIGS. 15*e*-15*f*.

Figure 17C:
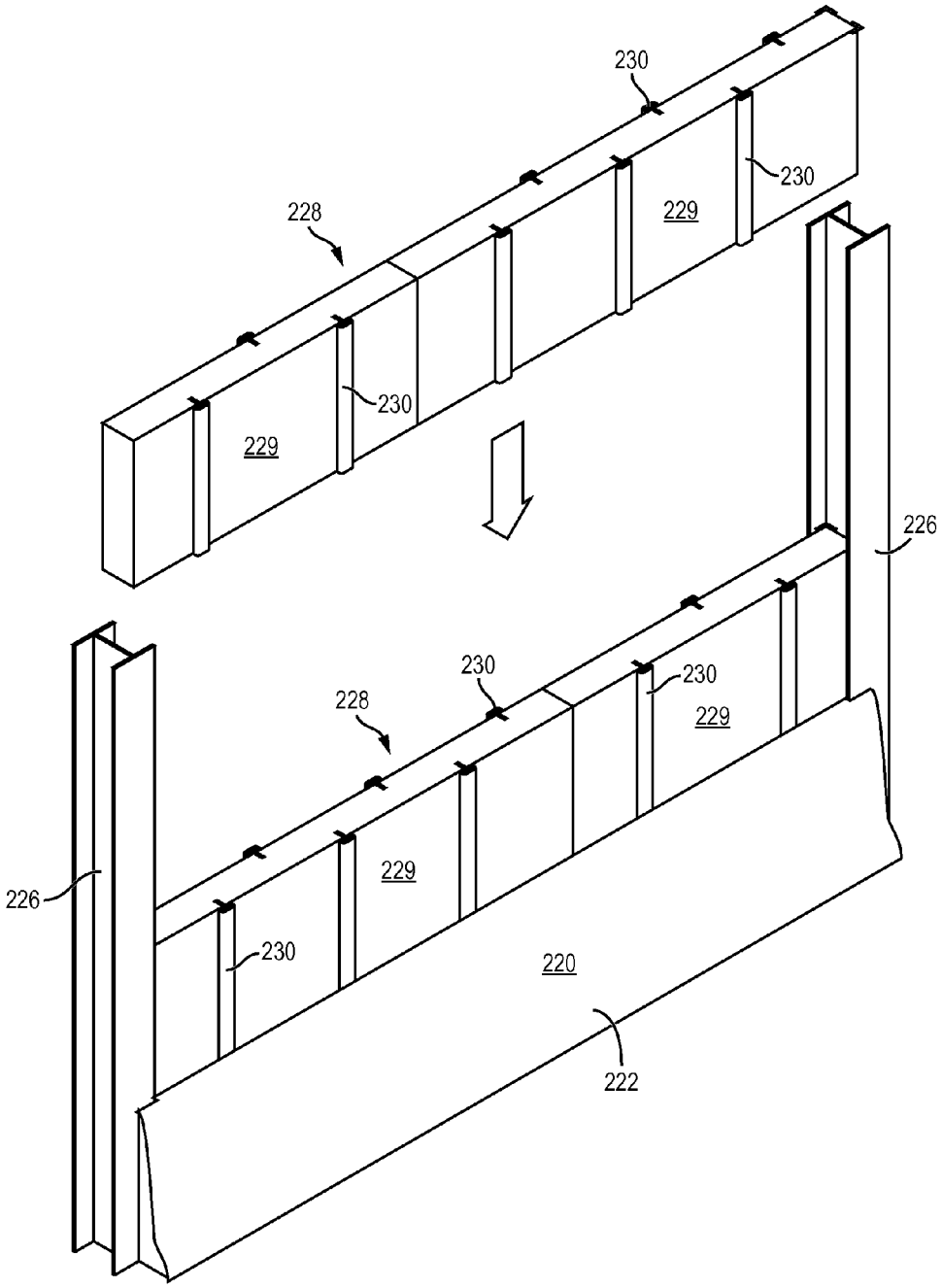

In FIG. 17*c*, a plurality of wall panels 228 is placed between wall stiffeners 226. Wall panels 228 include one or more sound insulating blocks 229 made with EPS foam, fiberglass, paper, or any other durable material. A plurality of support members or struts 230 is inserted into insulating blocks 196 to provide structural support and withstand the environmental elements, similar to FIG. 15*i*. An "I" beam can be placed in grooves or slots formed in a top surface of one wall panel 228 and bottom surface of the next level wall panel, similar to FIGS. 15*l*-15*n*.

Figure 17D:
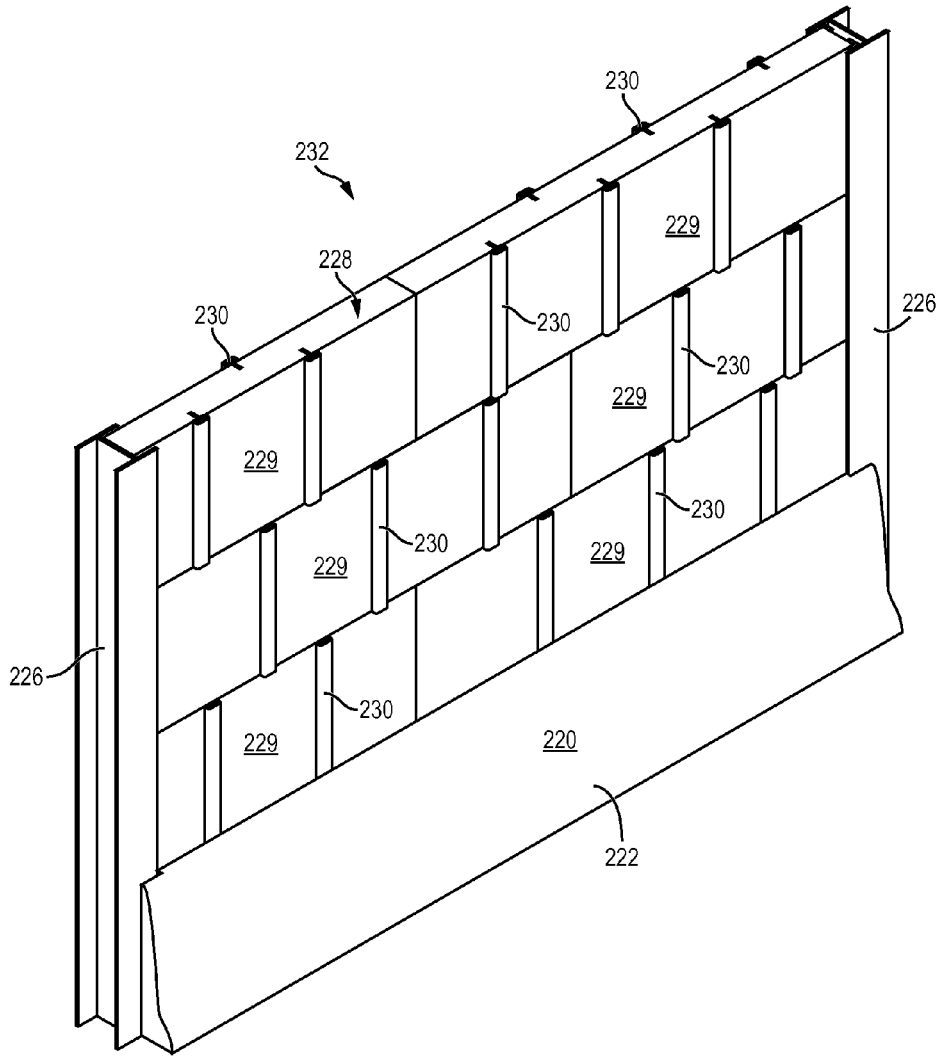
Figure 17E:
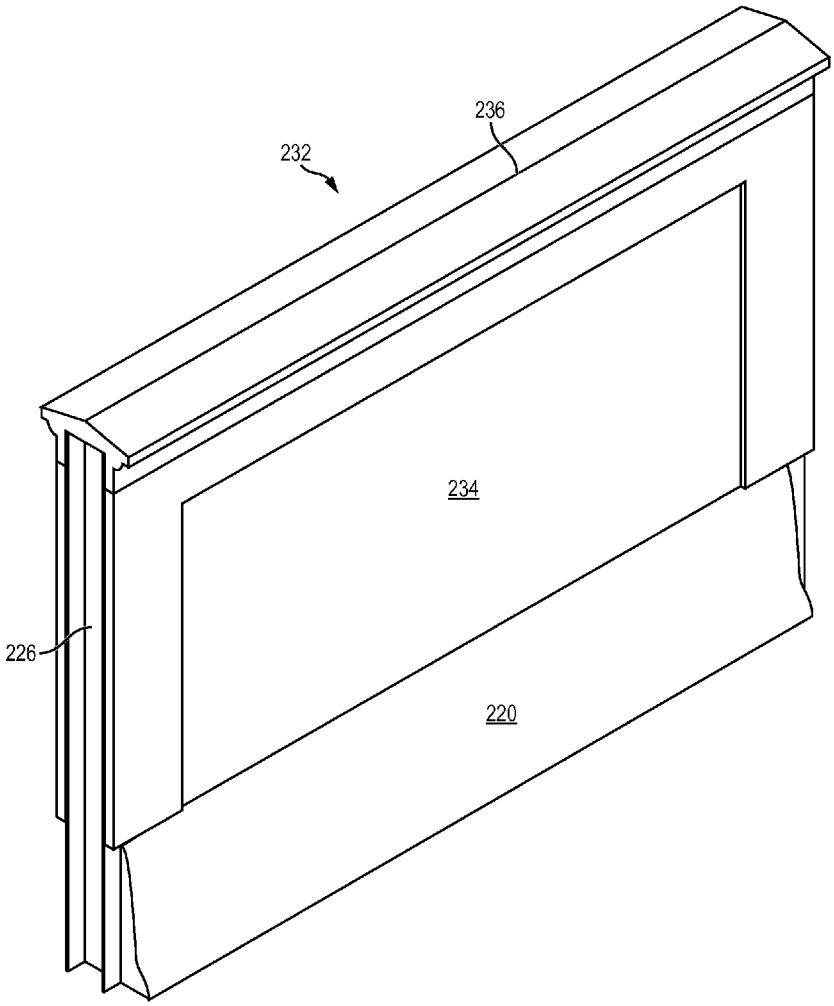

FIG. 17*d* shows one crash barrier wall section 232 with wall panels 228 stacked between wall stiffeners 226. In FIG. 17*e*, an external protective layer 234 is formed over wall stiffeners 226 and wall panels 228. Top cap 236 is placed over the stacked wall panels 228. The protective layer 234 and top cap 236 can be one or more coatings of STO (insulation and finish systems), stucco, fiberglass, or other weather-proof material for aesthetic appearance and environmental protection from outside elements, such as wind, rain, dust, and smog. The color options in stucco and fiberglass reduce the need for painting.

Figure 18:
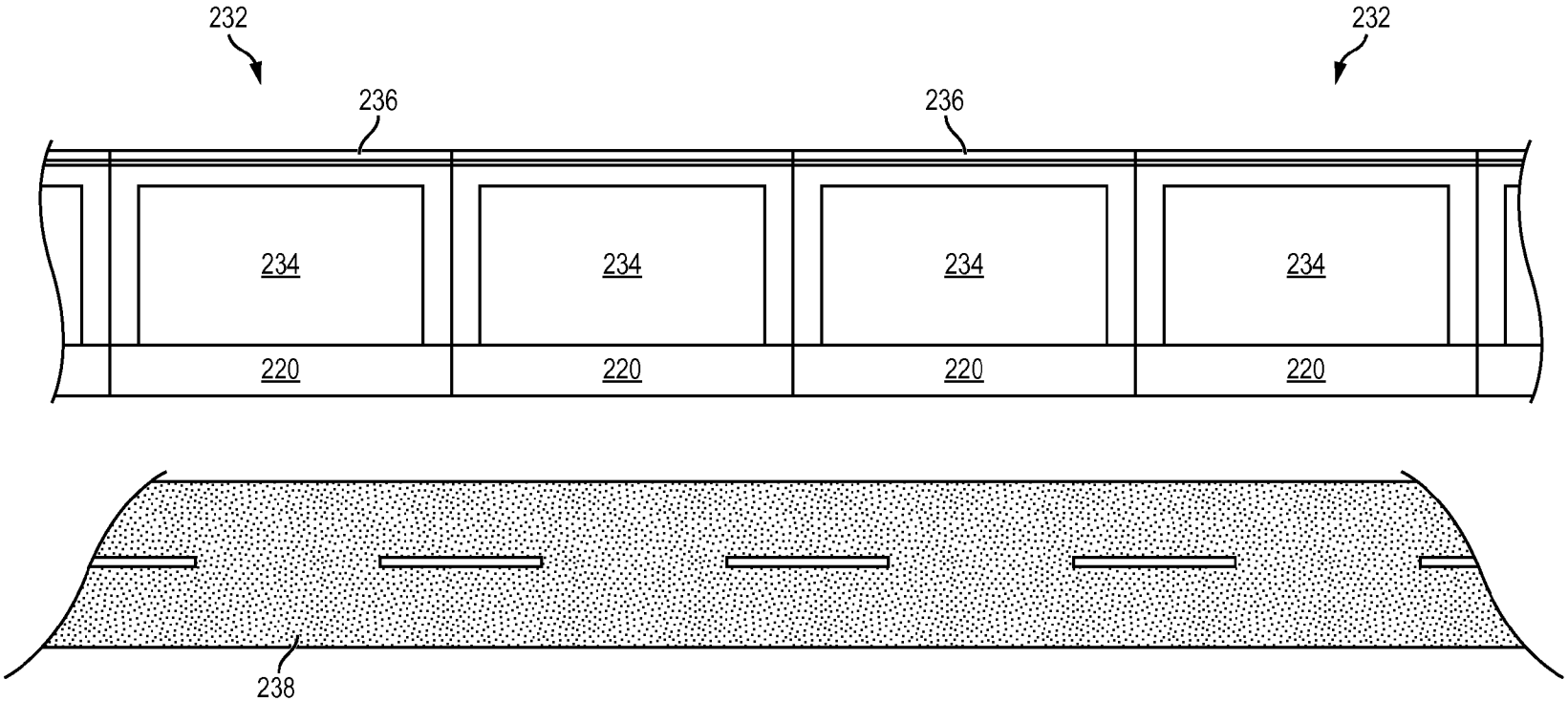
FIG. 18 illustrates the barrier wall formed over the crash barrier using wall panels disposed between wall stiffeners.

FIG. 18 shows a plurality of crash barrier wall sections 232 connected end-to-end along a length of roadway 238. The crash barrier wall serves to keep vehicles in the proper lane, as well as provides a sound barrier between roadway 238 and surrounding areas, in part due to the sound insulating blocks 229. The crash barrier wall is strong, light-weight, and durable due to the arrangement of support members 230 disposed in sound insulating blocks 229.

While one or more embodiments of the present invention have been illustrated in detail, the skilled artisan will appreciate that modifications and adaptations to those embodiments may be made without departing from the scope of the present invention as set forth in the following claims.

What is claimed is:

1. A barrier wall, comprising:

a plurality of vertical wall stiffeners including a base plate disposed at a distal end of the vertical wall stiffeners;

a crash barrier disposed between the vertical wall stiffeners;

a plurality of foam insulating blocks vertically stacked within channels of the vertical wall stiffeners over the crash barrier, wherein each foam insulating block includes a top surface and a bottom surface that are both substantially flat across an entire length and width of the foam insulating blocks;

a vertical support member including a stem portion of the vertical support member inserted into a side surface of the foam insulating blocks and oriented perpendicular to the side surface of the foam insulating blocks;

a first groove extending into the top surface of the foam insulating blocks approximately perpendicular to the top surface of the foam insulating blocks;

a second groove formed in the bottom surface of the foam insulating blocks;

a third groove extending into the top surface of the foam insulating blocks approximately perpendicular to the top surface of the foam insulating blocks;

a fourth groove formed in the bottom surface of the foam insulating blocks; and a horizontal support member extending across a center of the length of the foam insulating blocks and including a continuous piece of material within the first groove, second groove, third groove, and fourth groove.

2. The barrier wall of claim 1, further including stress relief material disposed between the foam insulating blocks and vertical wall stiffeners.

3. The barrier wall of claim 1, wherein the horizontal support member includes an "I" beam comprising two flanges and a web that is continuous for an entire length of the flanges.

4. The barrier wall of claim 1, further including a protective layer formed over the foam insulating blocks and vertical wall stiffeners.

5. A barrier wall, comprising:

a plurality of vertical wall support members;

a crash barrier disposed between the vertical wall support members;

a first wall panel disposed within channels of the vertical wall support members over the crash barrier, the first wall panel including, a first top surface, a first bottom surface, and a first groove and second groove extending approximately perpendicularly into the first top surface of the first wall panel, wherein the first top surface and first bottom surface are substantially flat across an entire length and width of the first wall panel outside the first groove and second groove;

a second wall panel disposed over the first wall panel, the second wall panel including, a second top surface, a second bottom surface, and a third groove and fourth groove extending approximately perpendicularly into the second bottom surface of the second wall panel, wherein the second top surface and second bottom surface are substantially flat across an entire length and width of the second wall panel outside the third groove and fourth groove; and a horizontal support member disposed in the first groove, second groove, third groove, and fourth groove between the first wall panel and second wall panel, wherein the horizontal support member includes an I-beam comprising a continuous piece of material extending into the first groove, second groove, third groove, and fourth groove.

6. The barrier wall of claim 5, wherein the vertical wall support members include an "I" beam.

7. The barrier wall of claim 5, further including a horizontal base support member disposed between the vertical wall support members.

8. The barrier wall of claim 5, further including a protective layer formed over the first wall panel and second wall panel.

9. A method of making a barrier wall, comprising:

providing a first vertical wall support member;

providing a second vertical wall support member;

disposing a crash barrier between the first vertical wall support member and second vertical wall support member and extending from the first vertical wall support member to the second vertical wall support member;

providing a first wall panel including a first foam block and a length of the first wall panel approximately equal to a distance from the first vertical wall support member to the second vertical wall support member, wherein a first top surface and a first bottom surface of the first wall panel are both substantially flat across an entire length and width of the first wall panel;

disposing the first wall panel on the crash barrier between the first vertical wall support member and second vertical wall support member by lifting the first wall panel over the first vertical wall support member and second vertical wall support member and inserting ends of the first wall panel into channels of the first vertical wall support member and second vertical wall support member;

forming a first groove and second groove extending substantially perpendicular into a top surface of the first wall panel;

disposing a horizontal support member in the first groove and second groove of the first wall panel;

providing a second wall panel including a second foam block and a second top surface and a second bottom surface of the second wall panel that are both substantially flat across an entire length and width of the second wall panel;

forming a third groove and fourth groove extending substantially perpendicularly into the second bottom surface of the second wall panel; and stacking the second wall panel over the first wall panel after disposing the horizontal support member in the first groove and second groove of the first wall panel with a continuous piece of material of the horizontal support member extending into the first groove, second groove, third groove, and fourth groove.

10. The method of claim 9, further including mounting a base plate to the first vertical wall support member.

11. The method of claim 9, further including forming a protective layer over the first wall panel and second wall panel.

12. The method of claim 9, further including disposing a top cap over the second wall panel.

13. A method of making a barrier wall, comprising:

providing a first vertical wall support member;

providing a second vertical wall support member;

disposing a crash barrier between the first vertical wall support member and second vertical wall support member;

disposing a first wall panel between the first vertical wall support member and second vertical wall support member, wherein the first wall panel includes a first top surface and a first bottom surface that are both substantially flat across an entire length and width of the first wall panel;

forming a first groove and second groove approximately perpendicularly into the first top surface;

inserting a horizontal support member into the first groove and second groove; and providing a second wall panel, wherein the second wall panel includes a second top surface and a second bottom surface that are both substantially flat across an entire length and width of the second wall panel;

forming a third groove and fourth groove approximately perpendicularly into the second bottom surface; and disposing the second wall panel over the first wall panel and horizontal support member with a continuous piece of material of the horizontal support member extending into the first groove, second groove, third groove, and fourth groove.

14. The method of claim 13, further including disposing a horizontal base support member between the first vertical wall support member and second vertical wall support member.

15. The method of claim 13, wherein the first wall panel is disposed within a first channel of the first vertical wall support member and a second channel of the second vertical wall support member.

16. The method of claim 13, wherein the first vertical wall support member and second vertical wall support member include an "I" shape.

17. The barrier wall of claim 5, further including a side end cap disposed over a corner of the first wall panel.

18. The method of claim 9, further including inserting a vertical support member into a side of the first wall panel.

19. The barrier wall of claim 5, further including an adhesive deposited into the first groove, second groove, third groove, and fourth groove.

20. The method of claim 9, further including depositing an adhesive into the first groove and second groove.

21. The barrier wall of claim 1, wherein each foam insulating block extends completely between two adjacent vertical wall stiffeners.

22. The method of claim 13, wherein the horizontal support member includes an I-beam comprising a first flange of the I-beam extending into the first wall panel and second wall panel.

* * * * *